US006432626B1

(12) United States Patent
Sugimoto et al.

(10) Patent No.: US 6,432,626 B1
(45) Date of Patent: Aug. 13, 2002

(54) SILVER HALIDE EMULSION AND SILVER HALIDE COLOR PHOTOGRAPHIC MATERIAL

(75) Inventors: Hideo Sugimoto; Sadayasu Ishikawa, both of Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/704,408

(22) Filed: Nov. 2, 2000

(30) Foreign Application Priority Data

Nov. 8, 1999 (JP) ..... 11-316956

(51) Int. Cl.[7] ..... G03C 1/005; G03C 1/494
(52) U.S. Cl. ..... 430/567; 430/569
(58) Field of Search ..... 430/567, 569

(56) References Cited

U.S. PATENT DOCUMENTS

| | | | | | |
|---|---|---|---|---|---|
| 4,853,322 | A | * | 8/1989 | Makino et al. | 430/567 |
| 5,587,280 | A | * | 12/1996 | Ikeda et al. | 430/567 |
| 5,591,570 | A | * | 1/1997 | Takiguchi et al. | 430/567 |
| 5,595,863 | A | | 1/1997 | Yamanouchi et al. | |
| 6,225,041 | B1 | * | 5/2001 | Takada | 430/567 |

FOREIGN PATENT DOCUMENTS

| | | |
|---|---|---|
| EP | 0611118 | 8/1994 |
| EP | 0829752 | 3/1998 |
| EP | 0859273 | 8/1998 |
| JP | 119359 | 4/1999 |

OTHER PUBLICATIONS

European Search Report EP 00 30 9870.

* cited by examiner

*Primary Examiner*—Geraldine Letscher
(74) *Attorney, Agent, or Firm*—Bierman, Muserlian and Lucas

(57) ABSTRACT

A silver halide emulsion is disclosed, comprising silver halide grains, wherein a variation coefficient of grain diameter of the whole silver halide grains is not more than 25%, wherein at least 50% of the total grain projected area is accounted for by tabular grains having two twin planes and an aspect ratio of not less than 6 and meeting the following requirement, $$1.0 \leqq b/a \leqq 1.3.$$

Photographic materials containing the silver halide emulsion is also disclosed.

13 Claims, 3 Drawing Sheets

SILVER HALIDE EMULSION AND SILVER HALIDE COLOR PHOTOGRAPHIC MATERIAL

FIELD OF THE INVENTION

The present invention relates to silver halide emulsions useful in the field of photography and silver halide light sensitive color photographic materials using the same, in particular, to a silver halide color photographic material exhibiting superiority in sensitivity, graininess, pressure characteristics, fogging, radiation fogging, aging stability, latent image keeping stability, latent image variation depending of temperature and humidity and productivity.

BACKGROUND OF THE INVENTION

Recently, along with the increased popularity of compact cameras, auto-focus single-lens reflex cameras and single-use cameras, a silver halide light sensitive color photographic material exhibiting further enhanced sensitivity and image quality has been desired by the public. Requirement for improvements in performance of silver halide photographic emulsions becomes severe and high level requirements for enhanced sensitivity, superior graininess and superior sharpness have been sought.

In response to such requirements, U.S. Pat. Nos. 4,434,226, 4,439,520, 4,414,310, 4,433,048, 4,414,306 and 4,459,353 disclose a technique of using tabular silver halide grains (hereinafter, also referred to as tabular grains), exhibiting advantages such as enhancement of sensitivity including enhancement of efficiency of spectral sensitivity with a sensitizing dye, an improvement in sensitivity/graininess, an enhancement of sharpness due to a specific optical property of the tabular grains and enhanced covering power. However, this technique is still insufficient in response to recent higher level requirements and still further enhanced performance is desired.

Relating to the trend of enhanced sensitivity and enhanced image quality, requirements for enhancement of pressure characteristics continues to increase. There have been made attempts to improve pressure characteristics by various means. It is generally regarded that a technique of enhancing pressure resistance of silver halide grains themselves is more preferred in terms of practical use and is considered to be more effective than a technique of adding additives such as an addition of a plasticizer.

On the other hand, enhancing uniformity among silver halide grains contained in a silver halide emulsion is also important to enhance performance of a silver halide photographic material using a silver halide emulsion. There are known various techniques giving attention to the uniformity among silver halide grains. Examples thereof include a technique concerning tabular silver halide grains uniform in grain size, as described in JP-A Nos. 1-213637, 5-173268 and 6-202258 (hereinafter, the term, JP-A refers to an examined and published Japanese Patent Application), a technique concerning tabular silver halide grains uniform being in grain thickness described in Japanese Patent Application No. 9-218567, a technique concerning tabular silver halide grains uniform being in grain size and thickness described in Japanese Patent Application No. 8-166040, and a technique concerning uniformity of dislocation lines in tabular silver halide grains described in Japanese Patent Application No. 8-149163. Further, JP-A No. 2-256043 describes a technique concerning silver halide grains uniform being in an average iodide content and WO89/06830 describes a technique concerning microscopic uniformity of halide composition within the silver halide grain.

With regard to the technique giving attention to the twin plane of tabular silver halide grains, JP-A 63-163451 describes a silver halide emulsion comprised of tabular grains having a grain diameter of 0.15 $\mu$m or more and an average aspect ratio of 8 or more and exhibiting a longest spacing between parallel twin planes to grain thickness of 5 or more, WO91/18320 describes a silver halide tabular grain emulsion having an average grain diameter of at least 0.6 $\mu$m and a spacing between parallel twin planes of 0.011 $\mu$m or less, JP-A 5-249585 describes a silver halide tabular grain emulsion having an aspect ratio of less than 4 and exhibiting a value of a grain thickness (T) divided by a spacing between twin planes (S) of more than 15, JP-A 8-110605 describes a silver halide emulsion comprised of tabular grains having an average spacing between twin planes ($d_0$) of 0.025 $\mu$m or less within the range of $0.8d_0$ to $1.2d_0$ $\mu$m, accounting for at least 75% of the total grain projected area, and JP-A 9-203985 describes a silver halide tabular grain emulsion having a spacing between twin planes of 0.025 $\mu$m or less and a variation coefficient of the spacing between twin planes of 40% or less, each of which shows improvements in sensitivity, graininess and pressure resistance. In any of these techniques, however, non-uniformity among silver halide grains is still pronounced and a further improvement in photographic performance is still remained.

U.S. Pat. No. 4,956,269 describes a technique of introducing dislocation lines into tabular silver halide grains to enhance sensitivity. It is commonly known that application of pressure to the silver halide grain results in fogging or desensitization and there are also problems such that the dislocation line-introduced grains were markedly desensitized upon application of pressure. JP-A 3-189642 describes a silver halide emulsion accounted for by tabular grains having an aspect ratio of 2 or more and 10 or more dislocation lines in the fringe portion of the grain, exhibiting monodisperse grain size distribution. However, marked desensitization caused by introduction of dislocation lines cannot be overcome by such a technique.

Further, one of the problems occurring along with enhanced sensitivity is an aging fog increase caused by a slight amount of radiation existing in the natural ambient environment, accompanied with reduced sensitivity and deteriorated graininess. As is well known, radiation having higher energy than visible light used in exposure of photographic materials causes interaction with substances, generating a number of secondary electrons. Interaction of the radiation with silver halide grains generates a number of secondary electrons for a very short period of time within the grain to form plural development-initiation points within the grain, even in low-exposure areas, so that a photographic material exposed to natural radiation causes more marked deterioration in graininess than that caused by fogging due to heat or humidity. Fog-increase caused by radiation is generally proportional to silver coverage of the photographic material so that reduction of silver coverage has been thought to be effective to reduce radiation fogging. However, since reduction of silver coverage results in reduced sensitivity, it is limited to achieve both enhanced sensitivity and reduced radiation fogging in a high-speed photographic material having higher silver coverage relative to a low-speed photographic material. Cited as a technique for reducing silver coverage without reducing sensitivity is the use of tabular grains, each which has a larger surface area relative to an identical volume. However, the use of tabular grains alone is insufficient to reduce radiation fogging. Further, a method for reducing radiation fogging by the use of a specific color developing agent is known, as described in JP-A 4-337737 but reduced sensitivity along with reduction of silver coverage is also shown therein.

Ultrafiltration is employed as a method for concentrating the volume of the reaction mixture (silver halide emulsion) in the process of emulsion making, as described in JP-B No. 59-43727 (hereinafter, the term, JP-B refers to published Japanese Patent) and JP-A 3-140946. However, in these disclosure are no suggestion with respect to tabular grains or a monodisperse silver halide tabular grain emulsion. JP-A 6-67326 describes a method in which ultrafiltration is applied during the stage of preparing a silver halide tabular grain emulsion to concentrate the reaction mixture, whereby not only the yield is enhanced but also tabular grains having an intermediate aspect ratio of 2 to 8. were obtained. In this disclosure, taking advantage of employing the fact that the aspect ration of silver halide grains systematically decreases along with concentration, a tabular grain emulsion having a high aspect ratio was concentrated by ultrafiltration to obtain an intermediate aspect ratio. However, silver halide emulsions exemplified in this disclosure, including comparative and inventive emulsions exhibiting 30% or more of a variation coefficient of grain size distribution, based on volume equivalent diameter and uniformity in shape or structure of the tabular grain, as one feature of the present invention was not obtained. Further, enhancement of uniformity of the grains, that is, precise control of grain thickness distribution, the distance between the major face and the closest twin plane, or spacing between twin planes is not intended in this disclosure.

Accordingly, precise control of silver halide grains is limited in the prior art, in which enhanced performance achieved by enhancing uniformity of the grains cannot be expected, and development of further prominent technique is desired.

SUMMARY OF THE INVENTION

In view of the foregoing, it is an object of the present invention to provide a silver halide emulsion having enhanced sensitivity and superior graininess and exhibiting superiority in pressure characteristics, radiation fogging and aging stability and a silver halide color photographic light sensitive material using the same.

The object of the present invention can be accomplished by the following means:

1. a silver halide emulsion comprising silver halide grains, wherein a variation coefficient of grain diameter of the whole silver halide grains is not more than 25%, wherein at least 50% of the total grain projected area is accounted for by tabular grains having two twin planes and an aspect ratio of not less than 6 and meeting the following requirement (1):

$$1.0 \leqq b/a \leqq 1.3 \quad (1)$$

wherein, of a distance between one major face and the twin plane closest thereto, and a distance between the other major face and the twin plane closest thereto, "a" is a shorter distance and "b" is a longer distance;

2. the silver halide emulsion as described in 1 above, wherein at least 50% by number of the tabular grains is accounted for by tabular grains having dislocation lines of 10 or more per grain which are localized in the peripheral region of the grain and an area ratio of the region occupied by the dislocation lines being 5 to 40% of the major face and a variation coefficient of the area ratio being not more than 30%;

3. the silver halide emulsion as described in 1 above, wherein a variation coefficient of grain thickness of the silver halide grains contained in the emulsion is not more than 30%;

4. the silver halide emulsion as described in 2 above, wherein a variation coefficient of grain thickness of the silver halide grains contained in the emulsion is not more than 30%;

5. the silver halide emulsion as described in 1 above, wherein the tabular grains have a mean spacing between twin planes of 0.013 to 0.017 $\mu$m;

6. the silver halide emulsion as described in 5 above, wherein the tabular grains have a mean grain thickness of 0.05 to 1.5 $\mu$m;

7. the silver halide emulsion as described in 1 above, wherein a variation coefficient of spacing between twin planes of the tabular grains is not more than 25%;

8. the silver halide emulsion as described in 5 above, wherein a variation coefficient of spacing between twin planes of the tabular grains is not more than 25%;

9. the silver halide emulsion as described in 1 above, wherein at least 50% by number of the tabular grains is accounted for by hexagonal tabular grains exhibiting a mean value of a ratio of maximum edge length to a minimum edge length of not more than 1.5, and a variation coefficient of the ratio of maximum edge length to a minimum edge length being not more than 25%;

10. the silver halide emulsion as described in 1 above, wherein a variation coefficient of iodide content distribution among the silver halide grains contained in the emulsion is not more than 25%;.

11. the silver halide emulsion as described in 1 above, wherein at least 40% by number of the tabular grains is accounted for by tabular grains having dislocation lines in the central and peripheral regions of the major face;

12. the silver halide emulsion as described in 1 above, wherein the silver halide emulsion is prepared by a process comprising nucleation and grain growth, wherein a part of water of the emulsion is removed through ultrafiltration over a period of after completion the nucleation and before completion of the grain growth to maintain the intergrain distance between silver halide grain or to decrease the intergrain distance;

13. a silver halide color photographic material comprising a support having thereon a red-sensitive layer, a green-sensitive layer, a blue-sensitive layer and a light-insensitive layer, wherein at least one of the red-, green- and blue-sensitive layers comprises the silver halide emulsion as described in 1 above.

DETAILED DESCRIPTION OF THE INVENTION

Figure 1:
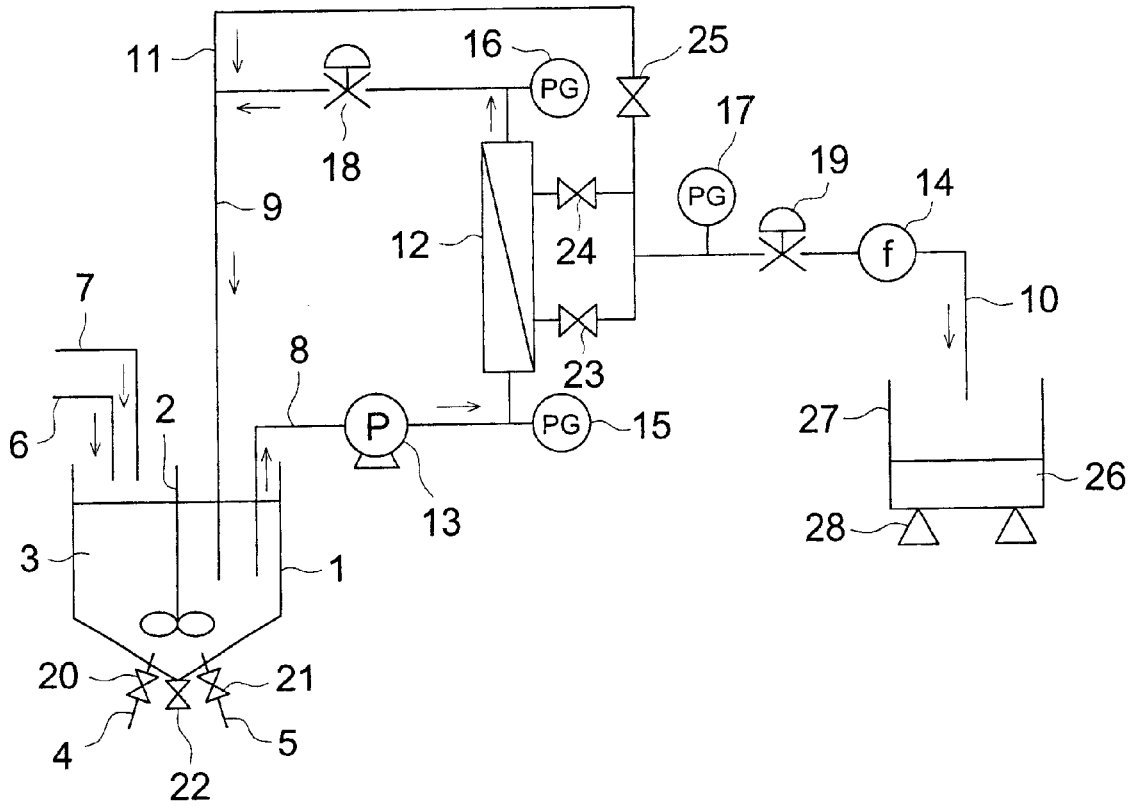
FIG. 1 illustrates an apparatus for preparing silver halide emulsions usable in this invention.

At least 50% of the total grain projected area of silver halide grains contained in the silver halide emulsion according to this invention is accounted for by tabular grains having an aspect ratio of 6 or more, preferably an aspect ration of 8 or more, and more preferably an aspect ratio of 10 or more. It is further preferred that at least 80% of the total grain projected area of silver halide grains contained in the silver halide emulsion according to this invention is accounted for by tabular grains having an aspect ratio of 6 or more, preferably an aspect ration of 8 or more, and more preferably an aspect ratio of 10 or more. The tabular grains are crystallographically classified as a twinned crystal. The twinned silver halide crystal refers to a silver halide crystal having at least one twin plane within the grain. Classification of twinned crystal forms is detailed in Klein & Moisar, Photographishe Korrespondenz Vol. 99, page 100 and ibid Vol. 100, page 57.

The aspect ratio refers to the ratio of a grain diameter of a silver halide grain to its grain thickness. When the tabular grain is viewed vertical to the major face, the grain diameter is the diameter of a circle having an area equivalent to the projected area, thus, it is a so-called circular equivalent diameter. To determine the aspect ratio, the diameter and thickness of silver halide grains are measured according to the following procedure. An emulsion containing tabular silver halide grains and latex balls having a known diameter as an internal standard is coated on a support to prepare a sample so that the major faces are arranged in parallel to the support. After the sample is subjected to shadowing at an angle by the carbon vacuum evaporation method, a replica sample is prepared by the conventional method. The diameter of the projected area and the thickness of the silver halide grain are determined from an electron micrograph of the sample, using an image processor. In this case, the thickness of the silver halide grain can be calculated from the internal standard and the shadow length of the silver halide grain.

The tabular grains according to this invention preferably exhibit a coefficient of variation (hereinafter, also denoted simply as variation coefficient) of grain diameter of not more than 25%, and more preferably not more than 20%. The variation coefficient of grain diameter is defined as below and determined based on the values obtained by measuring the grain diameter of 500 grains selected at random from the emulsion by the foregoing replica method:

Variation coefficient of grain diameter (%)=(standard deviation of grain diameter)/(average grain diameter)×100

The average grain diameter of silver halide grains used in this invention is preferably 0.2 to 10 μm, more preferably 0.3 to 7.0 μm, and still more preferably 0.4 to 5.0 μm.

Further, the tabular grains according to this invention preferably exhibit a variation coefficient of grain thickness of not more than 25%, more preferably not more than 20%, and still more preferably not more than 15%. The variation coefficient of grain thickness is defined as below and determined based on the values obtained by measuring the grain thickness of 500 grains selected at random the emulsion, by the foregoing replica method:

Variation coefficient of grain thickness (%)=(standard deviation of grain thickness)/(average grain thickness)×100

The average grain thickness of silver halide grains used in this invention is preferably 0.05 to 1.5 μm, and more preferably 0.07 to 0.50 μm.

The tabular grains used in this invention each preferably have two twin planes. The twin planes can be observed using a transmission electron microscope. Thus, a sample is prepared by coating a silver halide emulsion on a support so that the major faces of the grain are arranged in parallel to the support. The sample is sliced using a diamond cutter to obtain a slice of about 1 μm thickness. The number, position and distance of the twin plane(s) can be determined by the transmission electron microscopic observation of the slice.

The average value of spacings between two twin planes of the tabular grains can be determined as follows. Thus, in above-described the transmission electron microscopic observation of the slice, at least 1,000 tabular grains exhibiting a section which is cut vertically to the major face are selected at random, the spacing between twin planes parallel to the major faces is determined for each grain and the thus obtained spacings are averaged. The spacing between twin planes can be controlled by the optimal selection from the combination of factors affecting the supersaturated state at the stage of nucleation, including, for example, gelatin concentration, gelatin species, temperature, iodide ion concentration, pBr, pH, an ion-supplying rate and stirring rotation speed. The supersaturation factors are detailed in JP-A Nos. 63-92924 and 1-213637. In this invention, the mean spacing between twin planes is preferably 0.013 to 0.020 μm, more preferably 0.013 to 0.017 μm, and still more preferably 0.013 to 0.015 μm. The silver halide emulsion used in this invention is preferably comprised of monodisperse tabular grains with respect to the spacing between twin planes. Thus, the variation coefficient of spacing between twin planes, as defined below is preferably not more than 25%, more preferably not more than 20%, and still more preferably not more than 10%:

Variation coefficient of spacing between twin planes (%)=(standard deviation of spacing between twin planes/mean spacing between twin planes)×100

The distance between the major face and the twin plane closest to the major face can be determined through the foregoing transmission electron microscopic observation of the slice. Thus, when a straight line is drawn through near the center of the grain diameter and vertical to the parallel major faces, the shorter distance of the distance between one major face and the twin plane closest the major face and the distance between the other major face and a twin plane closest to the other major face is defidned as "a" and a longer distance is defined as "b". The values of "a" and "b" can be determined by measuring at least 500 grains selected at random.

Of a distance between one major face and the twin plane closest thereto and the distance between the other major face and a twin plane closest thereto, the shorter distance is denoted as "a" and the loner distance is denoted as "b", in which at least 50% of the tabular grains preferably meet $1.0 \leqq b/a \leqq 1.3$ and more preferably $1.0 \leqq b/a \leqq 1.2$.

At least 90% by number of the tabular grains according to this invention are preferably accounted for by hexagonal grains exhibiting the maximum edge ratio of not more than 1.5 (more preferably not more than 1.3, and still more preferably not more than 1.1). The maximum edge ratio refers to the ratio of the maximum edge length of edges forming the hexagon to the minimum edge length of the hexagonal tabular grain. The edge length of hexagonal tabular grains is determined by measuring all edge lengths of the silver halide grain based on the foregoing replica method using an image processing apparatus with respect to at least 500 grains contained in the emulsion. The silver halide hexagonal tabular grain emulsion used in this invention is preferably comprised of monodisperse tabular grains with respect to the maximum edge ratio. Thus, the variation coefficient of maximum edge ratio, as defined below is preferably not more than 25%, and more preferably not more than 20%:

Variation coefficient of maximum edge ratio (%)=(standard deviation of maximum edge ratio/mean maximum edge ratio)×100

The tabular grains used in this invention mainly comprise silver iodobromide and may comprise other silver halide such as silver chloride within the range providing no adverse effect. The iodide distribution within the silver halide grain can be detected by various physical measurement methods, including, for example, measurement of luminescence at low temperature, as described in Abstract of Annual meeting in 19681 of Society of Photographic Science of Japan, the EPMA method (Electron Probe Micro Analysis method) and X ray diffractometry. The iodide distribution within the grain and the mean iodide content can be determined by the EPMA method. In this method, a sample is prepared by dispersing emulsion grains so as not to be in contact with each other and elemental analysis of extremely minute site can be made through analysis of X-rays generated by electron beam excitation. The halide composition of each grain can be determined by measuring the intensity of characteristic X ray radiated from each grain. At least 500 grains are to be subjected to the EPMA method to determine their iodide contents and the average value thereof is regarded as the mean iodide content of the total grains. The silver halide emulsion used in this invention is preferably uniform with respect to the iodide content distribution among grains. Thus, the variation coefficient of the iodide content among grains, as defined below is preferably not more than 25%, more preferably not more than 20%, and still more preferably not more than 10%:

Variation coefficient of iodide content of grains (%)=(standard deviation of iodide content of grains/mean iodide content)×100

Silver halide grains contained in the silver halide emulsion used in this invention preferably are core/shell type grains. The core/shell type grains are those which are each comprised of a core covered by a shell. The shell may be comprised of one or more layers. The iodide contents of the core and shell preferably are different from each other.

Silver halide grains used in this invention may have dislocation lines. The dislocation lines in silver halide grains can be directly observed by means of transmision electron microscopy at a low temperature, for example, in accordance with methods described in J. F. Hamilton, Phot. Sci. Eng. 11 (1967) 57 and T. Shiozawa, Journal of the Society of Photographic Science and Technology of Japan, 35 (1972) 213. Silver halide tabular grains are taken out from an emulsion while making sure not to exert any pressure that causes dislocation in the grains, and they are then placed on a mesh for electron microscopy. The sample is observed by transmission electron microscopy, while being cooled to prevent the grain from being damaged by the electron beam. Since electron beam penetration is hampered as the grain thickness increases, sharper observations are obtained when using an electron microscope of high voltage. From the thus-obtained electron micrograph, the position and number of the dislocation lines in each grain can be determined.

The tabular grain used in this invention may contain dislocation lines in the central and peripheral regions of the major face. The central region of the major face of the tabular grain is defined as follows. Thus, when a circle inscribing the periphery of the major face and having a maximum diameter is drawn, the central region has a diameter of 80% of that of the inscribed circle and having a thickness equivalent to that of the tabular grain. In this case, the center of the major face is the center of the inscribed circle. The peripheral region of the tabular grain is the region outside the central region. The peripheral region has an area corresponding to the circular region outside the central region and a thickness equivalent to that of the tabular grain.

The number of dislocation lines located within the grain is measured in the following manner. A series of grain electron micrographs are taken at varying slope angles to the incident electron to confirm the presence of dislocation line(s). The dislocation lines are counted therefrom. In cases where the dislocation lines per grain cannot be counted, e.g., in such a case of the dislocation lines being closely present or the dislocation lines crossing over, it is counted as a large number of dislocation lines being present. Dislocation lines located in the central region of the major face of the tabular grains used in this invention often form a dislocation network and the number thereof cannot be precisely counted. On the other hand, the dislocation lines located in the peripheral region are observed as lines radially elongating from the center to the periphery of the grain, which often meander.

It is preferred that at least 50% by number of the emulsion grains used in this invention are tabular grains having dislocation lines of not less than 10 per grain in the peripheral region of the major face. It is more preferred that at least 70% by number of the emulsion grains used in this invention are tabular grains having dislocation lines of not less than 20 per grain in the peripheral region of the major face. It is still more preferred that at least 90% by number of the emulsion grains used in this invention are tabular grains having dislocation lines of not less than 30 per grain in the peripheral region of the major face.

Further, it is preferred that at least 40% by number of the emulsion grains used in this invention are tabular grains having dislocation lines in the central and peripheral regions of the major face, the number of the dislocation lines being 10 or more per grain. It is more preferred that at least 60% by number of the emulsion grains used in this invention are tabular grains having dislocation lines in the central and peripheral regions of the major face, the number of the dislocation lines being 20 or more per grain. It is still more preferred that at least 80% by number of the emulsion grains used in this invention are tabular grains having dislocation lines in the central and peripheral regions of the major face, the number of the dislocation lines being 30 or more per grain.

It is preferred that at least 50% of the total tabular grains are those having dislocation lines in the peripheral region of the major face, the dislocation lines occupying a region of 0.5 to 40%, more preferably 10 to 30%, and still more preferably 15 to 25%, based on the area of the peripheral region. The region occupied by the dislocation lines in the peripheral region is defined as follows. At least 1000 tabular grains are selected at random and when the (111) major face is observed directly from above using an electron microscopy, the length of dislocation line located in the peripheral region is measured for all edges of each and averaged out to obtain the mean length of the dislocation lines for each grain. The area of the region of from each edge to a distance of the mean length of the dislocation lines is defined as the region occupied by the dislocation lines in the peripheral region. The area of the major face and the area occupied by the dislocation lines located in the peripheral region are determined using an image processing apparatus. When the proportion of the area occupied by dislocation lines located in the peripheral region, based on the major face area (hereinafter, also denoted simply as area proportion of dislocation lines) is measured according to the above-described method, the distribution width, as defined below is preferably not more than 30%, more preferably not more than 20%, and still more preferably not more than 10%:

Variation coefficient of area proportion of dislocation lines (%)=(standard deviation of area proportion of dislocation lines/mean value of area proportion of dislocation lines)×100.

The method for introducing the dislocation lines into the silver halide grain is optional. The dislocation lines can be introduced by various methods, in which, at a desired position of introducing the dislocation lines during the course of forming silver halide grains, an aqueous iodide (e.g., potassium iodide) solution is added, along with an aqueous silver salt (e.g., silver nitrate) solution by a double jet technique, an iodide-containing fine grain emulsion is added, only an iodide solution is added, or an iodide ion releasing agent disclosed in JP-A No. 6-11781 is employed. Of these, it is preferable to add the iodide-containing fine grain emulsion or to use the iodide ion-releasing agent. Examples of the iodide ion-releasing agent include sodium p-iodoacetoamidobenzenesulfonate, 2-iodoethanol, and 2-iodoacetoamide.

In the tabular grains used in this invention, to allow the dislocation lines to selectively form in the central region of the major face, it is preferred to ripen the tabular grains so as to increase the grain thickness. In the ripening stage after nucleation, for example, ammonia as a silver halide solvent is added to increase the pH. However, in cases when the pH is increased excessively, the aspect ratio decreases, making it difficult to control the increase of the aspect ratio in the subsequent growth stage. It also unexpectedly causes fogging deterioration. Accordingly, the pH and temperature in the ripening stage is preferably 7.0 to 11.0 and 40 to 80° C., and more preferably 8.5 to 10.0 and 50 to 70° C., respectively.

In the tabular grains used in this invention, to allow the dislocation lines to selectively form in the peripheral region of the major face, it is important to increase the pAg in the grain growth after adding an iodide ion source to introduce dislocation lines in the peripheral region (e.g., an iodide-containing fine grain emulsion and iodide ion releasing agent) to substrate grains. However, in cases where the pAg is excessively increased, Ostwald ripening proceeds along with the grain growth, leading to deterioration in monodispersity of the tabular grains. Accordingly, the pAg to form dislocation lines in the peripheral region in the grain growth stage is preferably 8 to 12, and more preferably 9.5 to 11. Further, in cased where the iodide ion releasing agent is employed as an iodide ion source, an increased addition thereof effectively forms dislocation lines in the peripheral region. The addition amount of the iodide ion releasing agent is preferably not less than 0.5 mol per mol of silver halide, and more preferably 1 to 5 mol per mol of silver halide.

In general, the process of preparing silver halide emulsion grains is mainly divided to the nucleation stage, the ripening stage of the nucleus grains and the subsequent growth stage of the ripened nucleus grains. The growth stage may further comprise plural steps such as the first growth step and the second growth step. The ripening stage in the preparation of the silver halide grains used in this invention is the process in which regular crystal grains, single twinned crystal grains and non-parallel multiple twinned crystal grains which have been produced in the nucleation stage and are contained in the nucleus grain emulsion and have been produced are allowed to be disappeared employing Ostwald ripening and the proportion of grains having two parallel twin planes is increased. Exemplarily, lowering the pBr by increasing the $Br^-$ concentration, addition of a silver halide solvent such as ammonia and thioethers and ripening at a high temperature are preferably employed. The time of completion of ripening refers to the time immediately before adding an aqueous silver salt solution to the reaction vessel after completion of the nucleation and the time of starting the grain growth refers to the time of addition of an aqueous silver salt solution to the reaction vessel after completion of the nucleation.

To undergo precise control of the twin plane spacing, the ratio of the distance between one major face and the twin plane closest thereto to the distance between the other major face and the twin plane closest thereto and the mean grain thickness, it is preferred to conduct the operation to maintain or reduce the intergrain distance during the period of from the end of nucleation stage of silver halide grains to the end of grain growth stage by removing a part of the solution from the reaction mixture using a ultrafiltration membrane. It is specifically preferred that the volume of the reaction mixture solution at the time of completion of ripening is concentrated in comparison with that of the nucleation. In the removed solution, salts may or may not be contained. The volume of the reaction mixture in the reaction vessel at the start of growing grains is preferably ½, more preferably ⅓, and still more preferably ⅕ of the volume of the reaction mixture at the stage of nucleation. Examples of the concrete methods include a method in which concentration is carried out during the course of heating to the intended temperature and a method in which concentration is carried out after completion of heating.

The manufacturing facility used in this invention is an apparatus capable of preparing silver halide emulsions, which comprises a reaction vessel in which silver halide grains are formed, addition lines of various additive solutions used for forming the silver halide grains and a stirring mechanism for mixing the various additive solutions, and which may further comprise a concentration mechanism for the reaction mixture solution, such as a ultrafiltration apparatus whereby a mean intergrain distance is controlled during the stage of grain growth and a dilution mechanism for the reaction mixture solution, such as one which comprises an addition line of aqueous solution including water or a dispersion medium. The concentration mechanism is connected via pipes to the reaction vessel, in which the reaction mixture solution can be circulated at an intended rate between the reaction vessel and the concentration mechanism by means of a circulation mechanism such as a pump. The facility may further be installed with an apparatus for detecting the volume of a salt containing solution extracted from the reaction mixture solution through the concentration mechanism, having a mechanism capable of controlling the volume at the intended level. There can optionally be provided other function(s).

As one embodiment of the apparatus for preparing silver halide emulsions which is applicable to the manufacturing facilities used in this invention, a silver halide emulsion manufacturing apparatus, in which a mean intergrain distance can be controlled and maintained at an intended level during the grain growth using a ultrafiltration apparatus and an aqueous solution-adding line will be exemplarily explained, with reference to FIG. 1. Reaction vessel 1 contains dispersion medium 3, in advance. The apparatus comprises silver addition line 4 for adding to the reaction vessel an aqueous silver salt solution such as an aqueous silver nitrate solution, and halide addition line 5 for adding an aqueous halide solution such as an alkali metal bromide, iodide or chloride, an ammonium salt solution thereof, or a mixture thereof. The apparatus further comprises a dispersion medium addition line 6 to add a dispersion medium and a water addition line 7 to add water. There is also included stirring mechanism 2 for stirring a dispersion medium and a reaction solution (which is a mixture of a medium and silver halide grains) at the stage of silver halide emulsion preparation. The stirring mechanism may be any one of conventional types. The aqueous silver salt solution is added to the reaction vessel through silver addition line 4 at a rate controlled by silver addition bulb 20. The aqueous halide solution is added to the reaction vessel through halide addition line 5 at a rate controlled by halide addition bulb 21. In the figure, 22 indicates a liquid-draining bulb. Solutions may be added over the top surface of the reaction solution through silver addition line 4 and halide addition line 5, but is preferably added into the interior of the reaction solution, in the vicinity of the stirring mechanism (2). Stirring mechanism 2 allows aqueous silver salt and halide solutions to mix with the dispersion medium, enabling the soluble silver salt to react with the soluble halide to form silver halide.

In the first stage of formation of silver halide i.e. the nucleation stage is formed a dispersion (reaction solution) containing nucleus grains, optionally followed by the ripening stage. Thereafter, addition of the silver salt and halide solutions is further continued, being transferred to the second stage of the silver halide formation i.e. the growth stage, in which additional silver halide, produced as a reaction product deposit onto the nucleus grains to increase the grains in size. In the process of forming grains by adding the silver salt and halide solutions into the reaction vessel according to the invention, a portion of the reaction solution in the reaction vessel is sent by a circulation pump, through a liquid withdrawing line 8, to an ultrafiltration unit 12 and is returned to the reaction vessel through a liquid returning line 9. In this case, a portion of a soluble salt solution contained in the reaction solution is separated through an ultrafiltration unit 12 by adjusting pressure applied to the ultrafiltration unit with a pressure adjusting valve 18 which is provided in the course of the liquid returning line. Thereby, the grain formation with arbitrarily controlling the intergrain distance in the process of grain formation by adding silver salt and halide solutions into the reaction vessel becomes feasible.

When applying this method in the invention, it is preferred that the permeating amount of the soluble salt solution separated through the ultrafiltration membrane (ultrafiltration flux) is arbitrarily controlled. For example, the ultrafiltration flux can be arbitrarily controlled using a flow rate-adjusting valve 19 and a pressure gauge 17 provided in the course of a permeating solution drain line 10. In this case, to minimize variation in pressure of the ultrafiltration unit 12, a permeating solution-returning line 11 may be employed by opening a valve 25 provided in the course of the permeating solution-returning line. Or the permeating solution returning line may not be employed by closing the valve 25; it can be selected, depending on the operation conditions (herein 23 and 24 indicate valves). The ultrafiltration flux can be detected by using a flow meter 14 provided in the course of the permeating solution drain line 10, or detected from variation in weight of the permeating solution 26, by using a permeating solution receiving vessel 27 and a balance 28.

In the invention, concentration by means of ultrafiltration may be carried out continuously or intermittently during the course of grain growth. In applying the ultrafiltration in the grain growth process, after circulation of the reaction solution to the ultrafiltration stage is started, the circulation preferably continues at least until completion of the grain formation. Therefore, even when the concentration is interrupted, it is preferred to continue the circulation of the reaction solution to the ultrafiltration unit. This is because of avoiding the difference in grain growth between grains in the reaction vessel and those in the ultrafiltration stage. Further, it is preferred to make the circulating flow rate through the ultrafiltration stage sufficiently high. Concretely, a residence time in the ultrafiltration unit including withdrawing and returning lines of the reaction solution is preferably 30 sec or less, more preferably 15 sec. and still more preferably 10 sec. or less. The volume of the ultrafiltration stage including the solution withdrawing line 8, returning line 9, ultrafiltration unit 12, a circulating pump 13 and pressure gauges 15 and 16 is preferably 30% or less of the volume of the reaction vessel, more preferably 20% or less and still more preferably 10% or less.

Thus, the volume of total silver halide reaction solution can be arbitrarily reduced, during grain formation, by applying the ultrafiltration stage, as described above. In addition, the volume of the silver halide reaction solution can be kept constant at a given value by adding water from an addition line 7.

Ultrafiltration modules and circulating pumps which can be employed in performing the ultrafiltration according to the invention, are not limited, but it is preferable to avoid materials and structure which act on a silver halide emulsion to adversely affect photographic performance. Further, a differential molecular weight of an ultrafiltration membrane used in the ultrafiltration module can be optionally selected. For example, in cases where removing, during grain growth, a dispersing medium such as gelatin contained in a silver halide emulsion or a compound employed in preparation of the grains, there can be selected an ultrafiltration membrane having a differential molecular weight more than the molecular weight of the objective material. In cases where such material is not intended to. be removed, on the contrary, an ultrafiltration membrane having a lower differential molecular weight than the molecular weight of the material is selected.

The tabular silver halide grains used in this invention are prepared in the presence of a dispersion medium, i.e., in a solution containing a dispersion medium. The solution containing a dispersion medium, in which a protective colloid is formed in an aqueous solution with a substance capable of forming the protective colloid (or material capable of being a binder), such as gelatin, is preferably an aqueous solution containing gelatin in the form of a protective colloid.

Any gelatin is usable as protective colloid in this invention, including, for example, lime-processed gelatin and acid-processed gelatin. Preparation of gelatin is detailed in A. Veis, The Macromolecular Chemistry of Gelatin (Academic press, 1964). Examples of hydrophilic colloidal materials usable as protective colloid, other than gelatin include gelatin derivatives, graft polymers of gelatin with other polymers, proteins such as albumin and casein, cellulose derivatives such as hydroxyethyl cellulose, carboxymethyl cellulose and cellulose sulfuric acid esters, saccharide derivatives such as alginic acid and starch, synthetic hydrophilic polymers such as polyvinyl alcohol, polyvinyl alcohol partial acetal, poly-N-vinylpyrrolidone, polyacrylic acid, polymethacrylic acid, polyacrylamide, polyvinylimidazole, and polyvinylpyrazole, including their homopolymers and copolymers. There is preferably used gelatin exhibiting a gelly strength of 200 or more, based on the PAGI method.

The tabular grains used in this invention can be occluded (or doped) with a polyvalent metal compound. In this invention, the expression "doping" or "dope" refers to allowing a substance other than a silver ion or halide ion to be occluded in the interior of the silver halide grain. Further, the expression "dopant" refers to a compound to be doped within the grain and "metal dopant" refers to a polyvalent metal compound to be doped within the grain. Examples of preferred metal dopants include compounds of metals such as Mg, Al, Ca, Sc, Ti, V, Cr, mn, Fe, Co, Cu, Zn, Ga, Ge, Sr, Y, Zr, Nb, Mo, Yc, Ru, Rh, Pd, Cd, Sn, Ba, Ce, Eu, W, Re, Os, Ir, Pt, Hg, Tl, Pb, Bi and In. Doped metal compounds are preferably selected from single salts and metal complexes. The metal complexes are preferably a six-coordinate complex, five-coordinate complex, four-coordinate complex, and two-coordinate complex, and octahedral six-coordinate or planar four-coordinate complexes are specifically preferred. The complexes may be a polynuclear or single nuclear complex. Examples of ligands constituting the complex include $CN^-$, CO, $NO_2^-$, 1,10-phemthroline, 2,2'-bipyridine, $SO_3^{2-}$, ethylenediamine, $NH_3$, pyridine, $H_2O$, $NCS^-$, $CO^-$, $NO_3^-$, $SO_4^{2-}$, $OH^-$, $N_3^-$, $S_2^{2-}$, $F^-$, $Cl^-$, $B^-$ and $I^-$. Specifically preferred metal dopants include, for example, $K_4Fe(CN)_6$, $Pb(NO_3)_2$, $K_2IrCl_6$, $K_3IrCL_6$, $K_2IrBr_6$, and $InCl_3$.

Distribution of the metal dopant within a silver halide grain can be determined by gradual dissolution of the grain from the surface to the interior and measuring the dopant content at each portion. An exemplary method is described, as below. Prior to determination of the metal, a silver halide emulsion is treated in advance as follows. Thus, to about 30 ml of the emulsion, 50 ml of an aqueous 0.2% actinase solution is added and gelatin degradation is carried out with stirring at 40° C. for a period of 30 min. This operation is repeated five times. After centrifugal separation, five times of washing with 50 ml methanol, two time of washing with 50 ml 1 mol/l nitric acid solution and five times of washing with super pure water are conducted, and after centrifugal separation, silver halide alone is separated. The surface portion of the thus obtained silver halide grains is dissolved with an aqueous ammonia or pH-adjusted ammonia (in which the ammonia concentration and pH are varied in accordance with the kind or dissolution amount of silver halide). To dissolve the outermost surface of silver bromide grains, about 3% of the grain from the grain surface can be dissolved using 20 ml of an aqueous 10% ammonia solution per 2 g of silver halide. In this case, the dissolution amount of silver halide can be determined in such a manner that after undergoing dissolution of silver halide, an aqueous ammonia solution is separated from silver halide and the amount of silver contained in the resulting supernatant is determined by a high frequency inductively coupled plasma mass spectrometry (ICP-MS), high-frequency inductively coupled plasma emission spectrometry (ICP-AES) or atomic absorption spectrometry. The metal content within 3% from the grain surface can be determined from the difference the metal content of surface-dissolved silver halide and non-dissolved silver halide. Methods for determining the metal include, for example, that silver halide is dissolved with an aqueous ammonium thiosulfate solution, aqueous sodium thiosulfate solution or aqueous potassium cyanide solution, and then subjected to the matrix-matching ICP-MS method, ICP-AES method or atomic absorption spectrometry. Of these, in cases where employing potassium cyanide as a solvent and ICP-MS as an analysis instrument (e.g., available from FISON Elemental Analysis Corp.), after dissolving ca. 40 mg of silver halide in 5 ml of aqueous 0.2 mol/l solution, a solution of Cs as an internal standard element is added thereto so as to give a content of 10 ppb and super-pure water is further added to make 100 ml to prepare a measurement sample. Using a calibration curve obtained by allowing matrix to be met by the use of metal-free silver halide, the metal content of the sample is determined by the ICP-MS. In this case, the accurate silver content of the sample can be determined by diluting the sample with super pure water to 100 times and subjecting to the ICP-AES or atomic absorption spectrometry. Further, after conducting such dissolution of the grain surface, the metal content in the interior of the silver halide grain can be determined by repeating dissolution of the grain surface in a manner similar to the above, after washing the silver halide grain with super pure water. Determination of the metal doped in the peripheral region of the tabular grain can be made by having the ultra-thinned slice preparation method described above combined with the foregoing method of determining the metal content.

The content of a metal dopant in the tabular grains is preferably $1\times10^{-9}$ to $1\times10^{-4}$ mol, and more preferably $1\times10^{-8}$ to $1\times10^{-5}$ mol per mol of silver halide. The ratio of a metal dopant in the central region of the major face of tabular grains to that in the peripheral region thereof is preferably not less than 5, more preferably not less than 10, and still more preferably not less than 20.

The metal dopant displays effectively its effects when added to the substrate grains in the form of fine silver halide grains containing the metal dopant. In such a case, the content of the metal dopant is preferably $1\times10^{-7}$ to $1\times10^{-1}$, and more preferably $1\times10^{-5}$ to $1\times10^{-3}$ mol per mol of the fine silver halide grains. To allow a metal dopant to be doped in the fine grains, it is preferred to form fine grains in the form of the metal dopant being dissolved in a halide solution. The fine silver halide grains may be any one of silver bromide, silver iodide, silver chloride, silver iodobromide, silver chlorobromide and silver iodochlorobromide. Deposition of the fine silver halide grains containing a metal dopant onto the substrate grains can be carried out at any stage after completion of grain formation and before start of chemical sensitization, but preferably between completion of desalting and start of chemical sensitization. The fine silver halide grains, together with the metal dopant deposit onto the most active portion of the substrate grain, by adding the fine grains in the state of the salt concentration of the substrate emulsion being relatively low. Thus, deposition of the fine silver halide grains onto the peripheral region including the edges and corners of the tabular grains used in this invention can be efficiently achieved. The deposition means that the fine silver halide grains are not coagulated or adsorbed as such onto the substrate grains, but the fine silver halide grains are dissolved and reformed as silver halide onto the substrate grains in the reaction system of the fine silver halide grains and the substrate grains being concurrently present. In other words, when a part of the emulsion obtained according to the manner as described above is taken out and observed with an electron microscope, neither of the fine silver halide grains nor protrusion epitaxially deposited on the surface of the substrate grains are observed. The fine silver halide grains are added preferably in an amount of $1\times10^{-7}$ to 0.5, and more preferably $1\times10^{-5}$ to $1\times10^{-1}$ mol per mol of substrate grains.

The physical ripening condition for allowing the fine silver halide grains to deposit is selected from the range of 30 to 70° C./10 to 60 min. Furthermore, a metal dopant other than the foregoing dopants may be occluded within the range of providing no disadvantageous effect.

The tabular grains used in this invention may be subjected to reduction sensitization. The reduction sensitization is conducted by adding a reducing agent to a silver halide emulsion or a mixture solution for growing grains. Alternatively, the silver halide emulsion or mixture solution is subjected-to ripening or grain growth at a pAg of 7 or less, or at a ph of 7 or more. These methods may be combined.

As a preferable reducing agent are cited thiourea dioxide, ascorbic acid or its derivative, and a stannous salt. Furthermore, a borane compound, hydrazine derivative, formamidine sulfinic acid, silane compound, amine or polyamine and sulfite are cited. The addition amount thereof is preferably $10^{-8}$ to $10^{-2}$, and more preferably $10^{-6}$ to $10^{-4}$ mol per mol of silver halide. To conduct ripening at a low pAg, there may be added a silver salt, preferably aqueous soluble silver salt. As the aqueous silver salt is preferably silvernitrate. The pAg in the ripening is 7 or less, preferably 6 or less and more preferably 1 to 3 (herein, pAg=−log $[Ag^+]$). Ripening at a high pH is conducted by adding an alkaline compound to a silver halide emulsion or mixture solution for growing grains. As the alkaline compound are usable sodium hydroxide, potassium hydroxide, sodium carbonate, pottasium carbonate and ammonia. In a method in which ammoniacal silver nitrate is added for forming silver halide, an alkaline compound other than ammonia is preferably employed because of lowering an effect of ammonia. The silver salt or alkaline compound may be added instantaneously or over a period of a given time. In this case, it may be added at a constant rate or accelerated rate. It may be added dividedly in a necessary amount. It may be made present in a reaction vessel prior to the addition of aqueous-soluble silver salt and/or aqueous-soluble halide, or it may be added to an aqueous halide solution to be added. It may be added apart from the aqueous-soluble silver salt and halide.

The tabular grains used in this invention may contain a layer containing silver chalcogenide nuclei within the grain.

The silver chalcogenide nucleus-containing layer is preferably localized in the region outside of 50%, and more preferably 70% of the grain volume. The silver chalcogenide nucleus-containing layer may or may not be in contact with the grain surface. The silver chalcogenide nucleus contained in the silver chalcogenide nucleus-containing layer is clearly distinguished from a chemical sensitization nucleus of a chalcogenide formed by chemical sensitization, with respect to whether it forms a image forming center or not. The silver chalcogenide nucleus contained in the silver chalcogenide nucleus-containing layer within the grain needs to be lower in electron trapping ability than the chemical sensitization nucleus. The silver chalcogenide nucleus meeting such a requirement can be formed according the method described later.

The silver chalcogenide nucleus can be formed by addition of a chalcogen ion-releasing compound. Preferred silver chalcogenide nuclei include, for example, a silver sulfide nucleus, silver selenide nucleus, and a silver telluride nucleus, and more preferably silver sulfide nucleus. Preferred chalcogen ion-releasing compounds include compounds capable of releasing a sulfide ion, selenide ion or telluride ion. Preferred examples of the sulfide ion releasing compound include thiosulfonic acid compound, disulfide compound, thiosulfate, sulfide salt, thiocarbamide type compound, thioformamide type compound and rhodanine compound.

Preferred selenide ion-releasing compounds include compounds known as a selenium sensitizer. Examples thereof include colloidal senium element, isoselenocyanates (e.g., allyisoselenocyanate), selenoureas (e.g., N,N-dimethylselenourea, N,N,N'-triethylselenourea, N,N,N'-trimethyl-N'-heptafluoroselenourea, N,N,N'-trimethyl-N'-heptafluoropropylcarbonylselenourea, N,N,N'-trimethyl-N'-nitrophenylcarbonylselenourea, etc.), selenoketones (e.g., selenoacetoamide, N,N-dimethylselenobenzamide, etc.), selenophosphates (e.g., tri-p-triselenophosphate, etc.), and selenides (e.g., diethylselenide, diethyldiselenide, triethylphosphine selenide, etc.).

Examples of the telluride ion-releasing compounds include telluroureas (e.g., N,N-domethyltellurourea, tetramethyltellurourea, N-carboxyethyl-N,N'-dimethyltellurourea, etc.), phosphine tellurides (e.g., tributylphosphine tellurid, tricyclohexylphosphine telluride, triisopropylphosphine telluride, etc.), telluroamides (e.g., telluroacetoamide, N,N-dimethyltelluorobenzamide, etc.), telluroketones, telluroeaters, and isotellurocyanates.

Specifically preferred chalcogen ion-releasing compounds are thiosulfonic compounds represented by the following formulas (1) through (3):

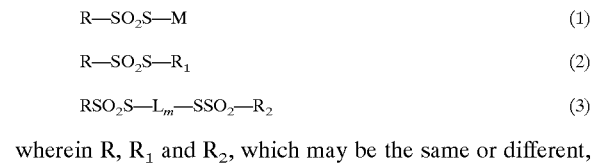

$$R—SO_2S—M \quad (1)$$

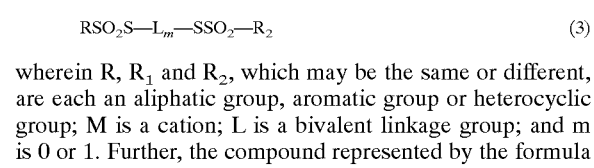

$$R—SO_2S—R_1 \quad (2)$$

$$RSO_2S—L_m—SSO_2—R_2 \quad (3)$$

wherein R, $R_1$ and $R_2$, which may be the same or different, are each an aliphatic group, aromatic group or heterocyclic group; M is a cation; L is a bivalent linkage group; and m is 0 or 1. Further, the compound represented by the formula (1), (2) or (3) may be a polymeric compound containing a repeating unit having a bivalent group derived from these structures; R, $R_1$, $R_2$, and L may combine with each other to form a ring.

A thiosulfonate compound represented by formulas (1) to (3) will be explained further in detail. In case of R, $R_1$ and $R_2$ being an aliphatic group, they are a saturated or unsaturated, straight or branched, or cyclic aliphatic hydrocarbon group; preferably, an alkyl group having 1 to 22 carbon atoms (e.g., methyl, ethyl, propyl, butyl, pentyl, hexyl, octyl, 2-ethylhexyl, decyl, dodecyl, hexadecyl, octadecyl, cyclohexyl, isopropyl, t0butyl, etc.); an alkenyl group having 2 to 22 carbon atoms (allyl, butenyl, etc.) and an alkynyl group (propargyl, butynyl etc.). These group may be substituted. In case of R, $R_1$ and $R_2$ being an aromatic group, they include a monocyclic and condensed ring, aromatic groups, preferably those having 6 to 20 carbon atoms such as phenyl. These may be substituted. In case of R, $R_1$ and $R_2$ being a heterocyclic group, they contain at least one selected from nitrogen, oxygen, sulfur, selenium and tellurium atoms, being each 3 to 15-membered ring (preferably, 3 to 6-membered ring) having at least one carbon atom, such as pyrroridine, piperidine, pyridine, tetrahydrofuran, thiophene, oxazole, thiazole, imidazole, benzothiazole, benzooxazole, benzimidazole, selenazole, benzoselenazole, tetrazole, triazole, benzotriazole, oxadiazole and thiadiazole.

As a substituent for R, $R_1$ and $R_2$, are cited an alkyl group (e.g., methyl, ethyl, hexyl etc.), alkoxy group (e.g., methoxy, ethoxy, octyloxy, etc.), aryl group (e.g., phenyl, naphthyl, tolyl etc.), hydroxy group, halogen atom (e.g., fuorine, chlorine, bromine, iodine), aryloxy group (e.g., pheoxy), alkylthio (e.g., methythio, butylthio), arylthio group (e.g., phenylthio), acyl group (e.g., acetyl, propinyl, butylyl, valeryl etc.), sulfonyl group (e.g., methysulfonyl, phenylsulfonyl), acylamino group (e.g., acetylamino, benzoylamino), sulfonylamino group (e.g., methanesulfonylamino, benzenesulfonylamino, etc.), acyoxy group (e.g., acetoxy, benzoxy, etc.), carboxy group, cyano group, sulfo group, amino group. $—SO_2SM$ group (M is a monovalent cation) and $—SO_2R_1$.

A bivalent linking group represented by L is an atom selected from C, N, S and O or an atomic group containing at least one of them. Examples thereof are an alkylene group, alkenylene group, alkynylene group, arylene group, —O—, —S—, —NH—, —CO— or $—SO_2—$, or a combination thereof. L is preferably a bivalent aliphatic or aromatic group. Examples of the aliphatic group include

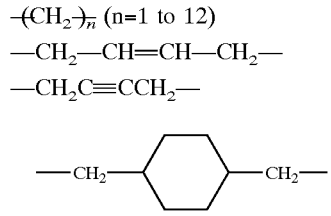

$$-(CH_2)_n- \text{ (n=1 to 12)}$$

$$—CH_2—CH=CH—CH_2—$$

$$—CH_2C\equiv CCH_2—$$

and xylylene group. As the aromatic group, are cited phenylene group and naphthylene group. These groups may have a substituent as afore-described.

M is preferably a metallic ion or organic cation. As the metallic ion are cited lithium ion, sodium ion and potassium ion. As the organic cation are cited an ammonium ion (e.g., ammonium, tetramethyammonium, tetrabutylammonium, etc.), phosphonium ion (e.g., tetraphenylphosphonium) and guanidyl group.

In the case where a compound represented by formulas (1) to (3) is a polymer, a repeating unit thereof is as follows. These polymer may be a homopolymer or copolymer with other copolymerizing monomers.

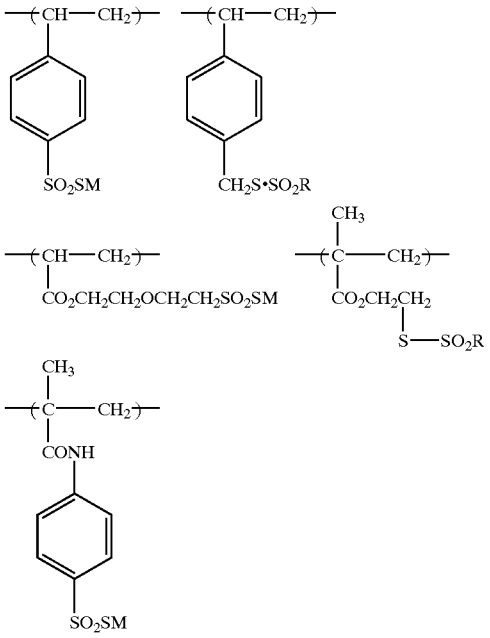

Examples of the compounds represented by formulas (1) to (3) are described in JP-A 54-1019, British Patent No. 972,211 and Journal of Organic Chemistry vol.53, page 396 (1988).

The compound capable of releasing a chalcogen ion to form a silver chalcogenide nucleus is added preferably in an amount of $10^{-8}$ to $10^{-2}$, and more preferably $10^{-6}$ to $10^{-3}$ mol per mol of silver halide. The chalcogen ion-releasing compound may be added instantaneously or over a period of time. The chalcogen ion-releasing compound may be added at a constant rate or at an accelerated rate, or may be added at some intervals. In any event, the formation of a silver chalcogenide nucleus must be done before completion of the grain formation. The formation of a silver chalcogenide nucleus after completion of the grain formation may or may not be done. The chalcogenide nucleus formed after the grain formation functions as a part of chemical sensitization nuclei formed during chemical sensitization and does not essentially contribute to the effects of this invention. In cases when silver halide grains are internally chemical-sensitized, a silver chalcogenide nucleus formed on the same face as chemical sensitization does not essentially contribute to the effects of this invention.

There can be employed various means for preparing tabular grains used in this invention, which are known in the art. Thus, a single jet addition, controlled double jet addition and a controlled triple addition are employed alone or in combination thereof. To obtain highly monodisperse grains, it is important to control the pAg in the liquid phase forming silver halide grains in accordance with the growth rate of silver halide grains. The pAg is preferably within the range of 7.0 to 12, and more preferably 7.5 to 11. The addition rate can be determined with reference to techniques described in JP-A Nos. 54-48521, and 58-49938. Commonly known silver halide solvents such as ammonia, thioethers and thioureas may be allowed to be present at the stage of preparation of the tabular grains.

The tabular grain emulsion used in this invention may be desalted to remove soluble salts after completion of the grain growth. Alternatively, desalting can be conducted at a time during the grain growth, as in the method described in JP-A no. 60-138538. Desalting can be made according to the methods described in Research Disclosure (hereinafter, also denoted simply as RD) 17643, sect. II. Thus, to remove soluble salts from the emulsion after grain formation or after physical ripening are applicable noodle washing which is made through gelation of gelatin, or coagulation washing (or flocculation washing) using inorganic salts, anionic surfactants, anionic polymers (such as polystyrene sulfonic acid) or gelatin derivatives (e.g., acylated gelatin, carbamoyl-modified gelatin, etc.). There can be also employed a method of using modified gelatin, in which the amino group of gelatin is substituted, as described in JP-A NO. 5-72658. A modified gelatin, i.e., chemically modified gelatin, in which the amino group of gelatin is carbamoylated is specifically preferred. In the chemically modified gelatin used for washing, the substitution factor of the amino group is preferably not less than 30%, more preferably not less than 50%, and still more preferably not less than 80%.

The tabular grains may be surface image forming grains or internally latent image forming grains. The tabular grains can be chemically sensitized according to the conventional method. Thus, sulfur sensitization, selenium sensitization and noble metal sensitization employing noble metal compounds such as gold compounds are employed alone or in combination thereof.

The tabular grains can be spectrally sensitized to the desired wavelength region using sensitizing dyes known in the photographic art. The sensitizing dye can be used alone or in combination. A dye having no spectrally sensitizing capability or a supersensitizer which is a compound having no visible absorption and capable of enhancing sensitizing action of the sensitizing dye may be incorporated,. together with a sensitizing dye, to the emulsion.

Antifoggants and stabilizers may be incorporated to the tabular grain emulsion used in this invention. Gelatin is advantageously employed as a binder. The emulsion layer or other hydrophilic colloid layers may be hardened. A plasticizer or water-soluble or water-insoluble synthetic polymer dispersion (so-called latex) may be incorporated.

Couplers are used in the emulsion layer of color photographic materials. There are further used a competing coupler having an effect of color correction or compounds releasing, on coupling with an oxidation product of a developing agent, a photographically useful fragment, such as development accelerator, developing agent, silver halide solvent, toning agent, hardener, fogging agent, antifoggant, chemical sensitizer, spectral sensitizer and desensitizer.

The photographic materials may be incorporated with a matting agent, lubricant, image stabilizer, formalin scavenger, UV absorbent, fluorescent brightener, surfactant, development accelerator and development retarder. Polyethylene-laminated paper, polyethylene terephthalate film, baryta paper, triacetyl cellulose film are used as a support.

The silver halide emulsion used in this invention is applied to color photographic materials such as color films and color print papers, displaying superior effects. Further, when applied to diffusion transfer photographic materials as described in JP-B No. 52-18024 (herein, the term, JP-B means a published Japanese Patent) and JP-A No. 11-509649, superior effects are displayed, which are also available in an integrated negative-positive reflection print unit and a peel-apart type reflection print. Thus, it was proved that application of the silver halide tabular grain emulsion used in this invention to such diffusion transfer photographic materials resulted in reduction of silver halide emulsion to be used, leading to effective utilization of the silver source, enhanced graininess and superior effects in progression of the image density or temperature dependence of exposure and development in the diffusion transfer photographic material.

EXAMPLES

The present invention will be further described based on examples but are by no means limited to these embodiments.

Example 1

Preparation of Emulsion EM-1

Nucleation Process

To a reaction vessel with a stirring apparatus described in JP-A No. 62-160128, reaction mother liquor (Gr-1) described below was added, maintained at 30° C. with stirring at 400 rpm and adjusted to a pH of 1.96 with an aqueous 0.5 mol/l sulfuric acid solution. Subsequently, solutions (S-1) and (H-1) were added thereto by double jet addition at a constant flow rate over a period of 1 min to form nucleus grains.

| | |
|---|---|
| (Gr-1) | |
| Alkali-processed inert gelatin (average molecular weight of 100,000) | 40.50 g |
| Potassiumbromide | 12.40 g |
| Distilled water to make | 16.2 lit. |
| (S-1) | |
| Silver nitrate | 862.5 g |
| Distilled water to make | 4.06 lit. |
| (H-1) | |
| Potassium bromide | 604.5 g |
| Distilled water to make | 4.06 lit. |

Ripening Process

After completion of the foregoing nucleation, solution (G-1) was added thereto and the temperature was raised to 60° C. in 30 min, while the silver potential of the reaction mixture (which was measured by a silver ion selection electrode with a saturated silver-silver chloride reference electrode) was maintained at 6 mV using an aqueous 2 mol/l potassium bromide solution. Subsequently, the pH was adjusted to 9.3 with aqueous ammonia and after maintained for 7 min, the pH was adjusted to 6.1 with aqueous acetic acid solution, while the silver potential was maintained at 6 mV with an aqueous 2 mol/l potassium bromide solution.

| (G-1) | |
|---|---|
| Alkali-processed inert gelatin (average molecular weight of 100,000) | 173.9 g |
| $HO(CH_2CH_2O)m(CH(CH_3)CH_2O)_{19.8}(CH_2CH_2O)nH$ (m + n = 9.77, 10% methanol solution) | 5.80 ml |
| Distilled water to make | 4.22 lit. |

Growth Process

After completion of ripening, solutions (S-1) and (H-1) were added by double jet addition at an accelerated flow rate (12 times from start to finish) over a period of 37 min. After completion of the addition, solution (G-2) was added and after adjusting the rotation speed to 550 rpm, solutions (S-2) and (H-2) were added by double jet addition at an accelerated flow rate (1.4 times from start to finish) over a period of 40 min, while the silver potential was maintained at 6 mV using an aqueous 2 mol/l potassium bromide solution. After completion of the foregoing adition, the temperature of the emulsion in the reaction vessel was lowered to 40° C. in 15 min. Subsequently were added solution (z-1) and then solution (SS), thereafter, the pH was adjusted to 9.3 with an aqueous potassium hydroxide solution and ripening was carried out for 4 min. to release an iodide ion. Subsequently, the pH was adjusted to 5.0 with an aqueous acetic acid solution and after the silver potential within the reaction vessel to −39 mV with an aqueous 3 mol/l potassium bromide solution, solutions (S-") and (H-2) were added at an accelerated flow rate (1.5 times faster at finish than at start) for a period of 25 min.

| | |
|---|---|
| (S-2) | |
| Silver nitrate | 2100 g |
| Distilled water to make | 3.53 lit. |
| (H-2) | |
| Potassium bromide | 859.5 g |
| Potassium iodide | 24.45 g |
| Distilled water to make | 2.11 lit. |
| (H-3) | |
| Potassium bromide | 587.0 g |
| Potassium iodide | 8.19 g |
| Distilled water to make | 1.42 lit. |
| (G-2) | |
| Osseingelatin | 284.9 g |
| $HO(CH_2CH_2O)m(CH(CH_3)CH_2O)_{19.8}(CH_2CH_2O)nH$ (m + n = 9.77, 10% methanol solution) | 7.75 ml |
| Distilled water to make | 1.93 lit. |
| (Z-1) | |
| Sodium p-iodoacetoamidobenzenesulfonate | 83.4 g |
| Distilled water to make | 1.00 lit. |
| (SS) | |
| Sodium sulfite | 29.0 g |
| Distilled water to make | 0.30 lit. |

After completion of the grain growth, the resulting emulsion was desalted according to the method described in JP-A 5-72658 and then after adding an aqueous gelatin solution thereto, the emulsion temperature was adjusted to 50° C. and ripening was carried out for 20 min. Thereafter, the temperature was lowered to 40° C. and the pH and pAg were adjusted to 5.80 and 8.06, respectively. The thus obtained emulsion was denoted as EM-1. From electron micrograph of the emulsion grains, it was proved that the emulsion grains were tabular grains having a mean grain diameter of 1.51 $\mu$m (i.e., mean value of the circular equivalent diameter of the grain projected area), 50% of the total grain projected area being accounted for by tabular grains exhibiting an aspect ratio of 6.7 or more and a variation coefficient of grain size distribution being 25%.

Preparation of Emulsions EM-2 through Em-6

Emulsion EM-2, which exhibited deteriorated variation coefficient of grain size distribution, was prepared in a manner similar to EM-1, except that the silver potential within the reaction vessel was maintained at −10 mV over the total growth process. From electron micrograph of the emulsion grains, it was proved that the emulsion grains were tabular grains having a mean grain diameter of 1.50 $\mu$m (i.e., mean value of the circular equivalent diameter of the grain projected area), 50% of the total grain projected area being accounted for by tabular grains exhibiting an aspect ratio of 7.0 or more and a variation coefficient of grain size distribution being 33%.

Emulsion EM-3 exhibiting a lower aspect ratio was prepared in a manner similar to EM-1, except that the silver potential within the reaction vessel was maintained at 6 mV over the total growth process. From electron micrograph of the emulsion grains, it was proved that the emulsion grains were tabular grains having a mean grain diameter of 1.17 μm (i.e., mean value of the circular equivalent diameter of the grain projected area), 50% of the total grain projected area being accounted for by tabular grains exhibiting an aspect ratio of 4.0 or more and a variation coefficient of grain size distribution being 25.0%.

Emulsion EM-4, which had no dislocation line in the central region of the major face of the tabular grains, was prepared in a manner similar to EM-1, except that the pH within the reaction vessel was maintained at 6.1 over the total growth process. From electron micrograph of the emulsion grains, it was proved that the emulsion grains were tabular grains having a mean grain diameter of 1.50 μm (i.e., mean value of the circular equivalent diameter of the grain projected area), 50% of the total grain projected area being accounted for by tabular grains exhibiting an aspect ratio of 7.2 or more and a variation coefficient of grain size distribution being 25%.

Emulsion EM-5, which had no dislocation line in the peripheral region of the major face, was prepared in a manner similar to EM-1, except that solution (Z-1) and (SS) used in the growth process were not added. From electron micrograph of the emulsion grains, it was proved that the emulsion grains were tabular grains having a mean grain diameter of 1.50 μm (i.e., mean value of the circular equivalent diameter of the grain projected area), 50% of the total grain projected area being accounted for by tabular grains exhibiting an aspect ratio of 7.2 or more and a variation coefficient of grain size distribution being 25.0%.

Emulsion EM-6, which had no dislocation line within the overall grain was prepared in a manner similar to EM-4, except that solution (Z-1) and (SS) used in the growth process were not added. From electron micrograph of the emulsion grains, it was proved that the emulsion grains were tabular grains having a mean grain diameter of 1.50 μm (i.e., mean value of the circular equivalent diameter of the grain projected area), 50% of the total grain projected area being accounted for by tabular grains exhibiting an aspect ratio of 7.2 or more and a variation coefficient of grain size distribution being 25.0%.

Preparation of Emulsion EM-7

Emulsion EM-7 was prepared in a manner similar to EM-1, except that the nucleation process and ripening process were varied as below.

Nucleation Process

To a reaction vessel with a stirring apparatus described in JP-A No. 62-160128, reaction mother liquor (Gr-1) described below was added, maintained at 30° C. with stirring at 400 rpm and adjusted to a pH of 1.96 with an aqueous 0.5 mol/l sulfuric acid solution. Subsequently, solutions (S-1) and (H-1) were added thereto by double jet addition at a constant flow rate over a period of 1 min to form nucleus grains.

| | |
|---|---|
| (Gr-1) | |
| Alkali-processed inert gelatin (average molecular weight of 100,000) | 40.50 g |
| Potassiumbromide | 12.40 g |
| Distilled water to make | 16.2 lit. |
| (S-1) | |
| Silver nitrate | 862.5 g |
| Distilled water to make | 4.06 lit. |

-continued

| | |
|---|---|
| (H-1) | |
| Potassium bromide | 604.5 g |
| Distilled water to make | 4.06 lit. |

Ripening Process

After completion of the foregoing nucleation, solution (G-1) was added thereto and the temperature was raised to 60° C. in 30 min, while the silver potential of the reaction mixture (which was measured by a silver ion selection electrode with a saturated silver-silver chloride reference electrode) was maintained at 6 mV using an aqueous 2 mol/l potassium bromide solution. Subsequently, the pH was adjusted to 9.3 with aqueous ammonia and after maintained for 7 min, the pH was adjusted to 6.1 with aqueous acetic acid solution, while the silver potential was maintained at 6 mV with an aqueous 2 mol/l potassium bromide solution.

| | |
|---|---|
| (G-1) | |
| Alkali-processed inert gelatin (average molecular weight of 100,000) | 173.9 g |
| $HO(CH_2CH_2O)m(CH(CH_3)CH_2O)_{19.8}(CH_2CH_2O)nH$ (m + n = 9.77, 10% methanol solution) | 5.80 ml |
| Distilled water to make | 4.22 lit. |

After completion of the grain growth, the emulsion was adjusted to a pH of 5.80 and EAg of 70 mV at 40° C. The thus obtained emulsion was denoted as EM-7. From electron micrograph of the emulsion grains, it was proved that the emulsion grains were tabular grains having a mean grain diameter of 1.85 μm (i.e., mean value of the circular equivalent diameter of the grain projected area), 50% of the total grain projected area being accounted for by tabular grains exhibiting an aspect ratio of 13.5 or more and a variation coefficient of grain size distribution being 33.0%.

Preparation of Emulsion EM-8

Employing the facility for manufacturing silver halide emulsions having constitution similar to FIG. 1, a silver halide emulsion was prepared according to the following procedure.

Nucleation Process

To a reaction vessel with a stirring apparatus described in JP-A No. 62-160128, reaction mother liquor (Gr-1) described below was added, maintained at 30° C. with stirring at 400 rpm and adjusted to a pH of 1.96 with an aqueous 0.5 mol/l sulfuric acid solution. Subsequently, solutions (S-1) and (H-1) were added thereto by double jet addition at a constant flow rate over a period of 1 min to form nucleus grains.

| | |
|---|---|
| (Gr-1) | |
| Alkali-processed inert gelatin (average molecular weight of 100,000) | 40.50 g |
| Potassiumbromide | 12.40 g |
| Distilled water to make | 16.20 lit. |
| (S-1) | |
| Silver nitrate | 862.5 g |
| Distilled water to make | 4.06 lit. |
| (H-1) | |
| Potassium bromide | 604.5 g |
| Distilled water to make | 4.06 lit. |

Ripening Process

After completion of the foregoing nucleation, solution (G-1) was added thereto and the temperature was raised to 60° C. in 30 min, while the silver potential of the reaction mixture (which was measured by a silver ion selection electrode with a saturated silver-silver chloride reference electrode) was maintained at 6 mV using an aqueous 2 mol/l potassium bromide solution. Subsequently, the pH was adjusted to 9.3 with aqueous ammonia and after maintained for 7 min, the pH was adjusted to 6.1 with aqueous acetic acid solution, while the silver potential was maintained at 6 mV with an aqueous 2 mol/l potassium bromide solution. Further, at the time the temperature reached 60° C., the reaction mixture solution within the reaction vessel was circulated to the ultrafiltration unit to remove an aqueous solution in an amount corresponding to the amount of each adding solution, from the reaction solution and the reaction solution within the reaction vessel was concentrated to a half of the reaction solution volume in the nucleation process.

| (G-1) | |
|---|---|
| Alkali-processed inert gelatin (average molecular weight of 100,000) | 173.9 g |
| $HO(CH_2CH_2O)m(CH(CH_3)CH_2O)_{19.8}(CH_2CH_2O)nH$ (m + n = 9.77, 10% methanol solution) | 5.80 ml |
| Distilled water to make | 4.22 lit. |

Growth Process

After completion of ripening, solutions (S-1) and (H-1) were added by double jet addition at an accelerated flow rate (12 times from start to finish) over a period of 37 min. After completion of the addition, solution (G-2) was added and after adjusting the rotation speed to 550 rpm, solutions (S-2) and (H-2) were added by double jet addition at an accelerated flow rate (1.4 times from start to finish) over a period of 40 min, while the silver potential was maintained at 6 mV using an aqueous 2 mol/l potassium bromide solution. After completion of the foregoing addition, the temperature of the emulsion in the reaction vessel was lowered to 40° C. in 15 min. Subsequently were added solution (z-1) and then solution (SS), thereafter, the pH was adjusted to 9.3 with an aqueous potassium hydroxide solution and ripening was carried out for 4 min. to release an iodide ion. Subsequently, the pH was adjusted to 5.0 with an aqueous acetic acid solution and after the silver potential within the reaction vessel to −39 mV with an aqueous 3 mol/l potassium bromide solution, solutions (S-") and (H-2) were added at an accelerated flow rate (1.5 times faster at finish than at start) for a period of 25 min, while the silver potential within the reaction vessel was maintained at −39 mV.

| (S-2) | |
|---|---|
| Silver nitrate | 2.10 kg |
| Distilled water to make | 3.53 lit. |
| (H-2) | |
| Potassium bromide | 859.5 g |
| Potassium iodide | 24.45 g |
| Distilled water to make | 2.11 lit. |
| (H-3) | |
| Potassium bromide | 587.0 g |
| Potassium iodide | 8.19 g |
| Distilled water to make | 1.42 lit. |
| (G-2) | |
| Osseingelatin | 284.9 g |
| $HO(CH_2CH_2O)m(CH(CH_3)CH_2O)_{19.8}(CH_2CH_2O)nH$ (m + n = 9.77, 10% methanol solution) | 5.80 ml |
| Distilled water to make | 1.93 lit. |

-continued

| (Z-1) | |
|---|---|
| Sodium p-iodoacetoamidobenzenesulfonate | 83.4 g |
| Distilled water to make | 1.00 lit. |
| (SS) | |
| Sodium sulfite | 29.0 g |
| Distilled water to make | 0.30 lit. |

After completion of the grain growth, the resulting emulsion was desalted according to the method described in JP-A 5-72658 and then after adding an aqueous gelatin solution thereto, the emulsion temperature was adjusted to 50° C. and ripening was carried out for 20 min. Thereafter, the temperature was lowered to 40° C. and the pH and pAg were adjusted to 5.80 and 8.06, respectively. The thus obtained emulsion was denoted as EM-8. From electron micrograph of the emulsion grains, it was proved that the emulsion grains were tabular grains having a mean grain diameter of 1.51 μm (i.e., mean value of the circular equivalent diameter of the grain projected area), 50% of the total grain projected area being accounted for by tabular grains exhibiting an aspect ratio of 7.4 or more and a variation coefficient of grain size distribution being 24.0%.

Preparation of Emulsions EM-9 through EM-16

Emulsion EM-9, which had no dislocation line within the overall grain was prepared in a manner similar to EM-8, except that the pH was maintained at 6.1 during the ripening process and solution (Z-1) and (SS) used in the growth process were not added. From electron micrograph of the emulsion grains, it was proved that the emulsion grains were tabular grains having a mean grain diameter of 1.55 μm (i.e., mean value of grain diameter parallel to the major face), 50% of the total grain projected area being accounted for by tabular grains exhibiting an aspect ratio of 7.4 or more and a variation coefficient of grain size distribution of 24.0%.

Emulsion EM-10, which had no dislocation line in the central region of the major face of the tabular grains, was prepared in a manner similar to EM-1, except that the pH within the reaction vessel was maintained at 6.1 over the total growth process. From electron micrograph of the emulsion grains, it was proved that the emulsion grains were tabular grains having a mean grain diameter of 1.57 μm (i.e., mean value of grain diameter parallel to the major face), 50% of the total grain projected area being accounted for tabular grains exhibiting an aspect ratio of 7.5 or more and a variation coefficient of grain size distribution of 24.0%.

Emulsion EM-11 was prepared in a manner similar to EM-8, except that solutions (Z-1) and (SS) were added in an amount of 40% of the total silver amount in the growth process. After completion of completion of the grain growth, the emulsion was adjusted to a pH of 5.80 and an EAg of 70 mV, similarly to EM-8. The thus obtained emulsion was denoted as EM-11. From electron micrograph of the emulsion grains, it was proved that the emulsion grains were tabular grains having a mean grain diameter of 1.50 μm (i.e., mean value of grain diameter parallel to the major face), 50% of the total grain projected area being accounted for by tabular grains exhibiting an aspect ratio of 6.7 or more and a variation coefficient of grain size distribution being 24.0%.

Emulsion EM-12 was prepared in a manner similar to EM-8, except that solutions (Z-1) and (SS) were added in an amount of 95% of the total silver amount in the growth process. After completion of completion of the grain growth, the emulsion was adjusted to a pH of 5.80 and an EAg of 70 mV, similarly to EM-8. The thus obtained emulsion was denoted as EM-12. From electron micrograph of the emulsion grains, it was proved that the emulsion grains were tabular grains having a mean grain diameter of 1.55 μm (i.e., mean value of grain diameter parallel to the major face), 50% of the total grain projected area being accounted for by tabular grains exhibiting an aspect ratio of 6.8 or more and a variation coefficient of grain size distribution being 23.5%.

Emulsion EM-13 was prepared in a manner similar to EM-8, except that the ripening process was varied as below.

Ripening Process

After completion of nucleation, solution (G-1) was added and the temperature of the reaction mixture was raised to 60° C. in 30 min, while the silver potential was maintained at 6 mV (which was measured using a silver ion selection electrode and a reference electrode of saturated silver-silver chloride) using an aqueous 2N potassium bromide solution. Subsequently, the pH was adjusted to 9.3 by adding aqueous ammonia and the reaction mixture was held further for 7 min, then the pH was adjusted to 6.1 using an aqueous acetic acid solution, while the silver potential was maintained at 6 mV using an aqueous 2N potassium bromide solution. Further, at the time the temperature reached 60° C., the reaction mixture solution within the reaction vessel was circulated to the ultrafiltration unit to remove an aqueous solution in an amount corresponding to the amount of each adding solution, from the reaction solution and the reaction solution within the reaction vessel was concentrated to ⅔ of the reaction solution volume in the nucleation process.

| (G-1) | |
|---|---|
| Alkali-processed inert gelatin (average molecular weight of 100,000) | 173.9 g |
| $HO(CH_2CH_2O)m(CH(CH_3)CH_2O)_{19.8}(CH_2CH_2O)nH$ (m + n = 9.77, 10% methanol solution) | 4.35 ml |
| Distilled water to make | 4.22 lit. |

After completion of completion of the grain growth, the emulsion was adjusted to a pH of 5.80 and an EAg of 70 mV, similarly to EM-8. The thus obtained emulsion was denoted as EM-13. From electron micrographs of the emulsion grains, it was proved that the emulsion grains were tabular grains having a mean grain diameter of 1.55 μm (i.e., mean value of grain diameter parallel to the major face), 50% of the total grain projected area being accounted for by tabular grains exhibiting an aspect ratio of 7.4 or more and a variation coefficient of grain size distribution being 24.5%.

Emulsion EM-14 was prepared in a manner similar to EM-8, except that the reaction solution in the ripening process was concentrated to ⅓ of the reaction solution in the nucleation and after adding solutions (S-1) and (H-1) in the growth process, solution (G-2) was added, then hot water of equivalent volume to the solution drained in the ripening process was added prior to the addition of solutions (S-2) and (H-2) and thereafter, draining was made so that the constant liquid volume in the reaction vessel was maintained. After completion of completion of the grain growth, the emulsion was adjusted to a pH of 5.80 and a EAg of 70 mV, similarly to EM-8. The thus obtained emulsion was denoted as EM-14. From electron micrograph of the emulsion grains, it was proved that the emulsion grains were tabular grains having a mean grain diameter of 1.60 μm (i.e., mean value of grain diameter parallel to the major face), 50% of the total grain projected area being accounted for by tabular grains exhibiting an aspect ratio of 8.2 or more and a variation coefficient of grain size distribution being 22.0%.

Emulsion EM-15 was prepared in a manner similar to EM-14, except that the reaction solution in the ripening process was concentrated to ⅕ of the reaction solution in the nucleation. After completion of completion of the grain growth, the emulsion was adjusted to a pH of 5.80 and an EAg of 70 mV, similarly to EM-8. The thus obtained emulsion was denoted as EM-15. From electron micrograph of the emulsion grains, it was proved that the emulsion grains were tabular grains having a mean grain diameter of 1.60 μm (i.e., mean value of grain diameter parallel to the major face), 50% of the total grain projected area being accounted for by tabular grains exhibiting an aspect ratio of 8.0 or more and a variation coefficient of grain size distribution being 17.0%.

Emulsion EM-16 was prepared in a manner similar to EM-14, except that the nucleation process and ripening process were varied as below.

Nucleation Process

To a reaction vessel with a stirring apparatus described in JP-A No. 62-160128, reaction mother liquor (Gr-1) described below was added, maintained at 30° C. with stirring at 400 rpm and adjusted to a pH of 1.96 with an aqueous 0.5 mol/l sulfuric acid solution. Subsequently, solutions (S-1) and (H-1) were added thereto by double jet addition at a constant flow rate over a period of 1 min to form nucleus grains.

| (Gr-1) | |
|---|---|
| Alkali-processed inert gelatin (average molecular weight of 100,000) | 405.0 g |
| Potassiumbromide | 124.0 g |
| Distilled water to make | 162.0 lit. |
| (S-1) | |
| Silver nitrate | 862.5 g |
| Distilled water to make | 4.06 lit. |
| (H-1) | |
| Potassium bromide | 604.5 g |
| Distilled water to make | 4.06 lit. |

Ripening Process

After completion of the foregoing nucleation, solution (G-1) was added thereto and the temperature was raised to 60° C. in 30 min, while the silver potential of the reaction mixture (which was measured by a silver ion selection electrode with a saturated silver-silver chloride reference electrode) was maintained at 6 mV using an aqueous 2 mol/l potassium bromide solution. Subsequently, the pH was. adjusted to 9.3 with aqueous ammonia and after maintained for 7 min, the pH was adjusted to 6.1 with aqueous acetic acid solution, while the silver potential was maintained at 6 mV with an aqueous 2 mol/l potassium bromide solution. Further, at the time the temperature reached 60° C., the reaction mixture solution within the reaction vessel was circulated to the ultrafiltration unit to remove an aqueous solution in an amount corresponding to the amount of each adding solution, from the reaction solution and the reaction solution within the reaction vessel was concentrated to ⅕ of the reaction solution in the nucleation process.

| (G-1) | |
|---|---|
| Alkali-processed inert gelatin (average molecular weight of 100,000) | 173.9 g |
| $HO(CH_2CH_2O)m(CH(CH_3)CH_2O)_{19.8}(CH_2CH_2O)nH$ (m + n = 9.77, 10% methanol solution) | 5.80 ml |
| Distilled water to make | 4.22 lit. |

Figure 2:
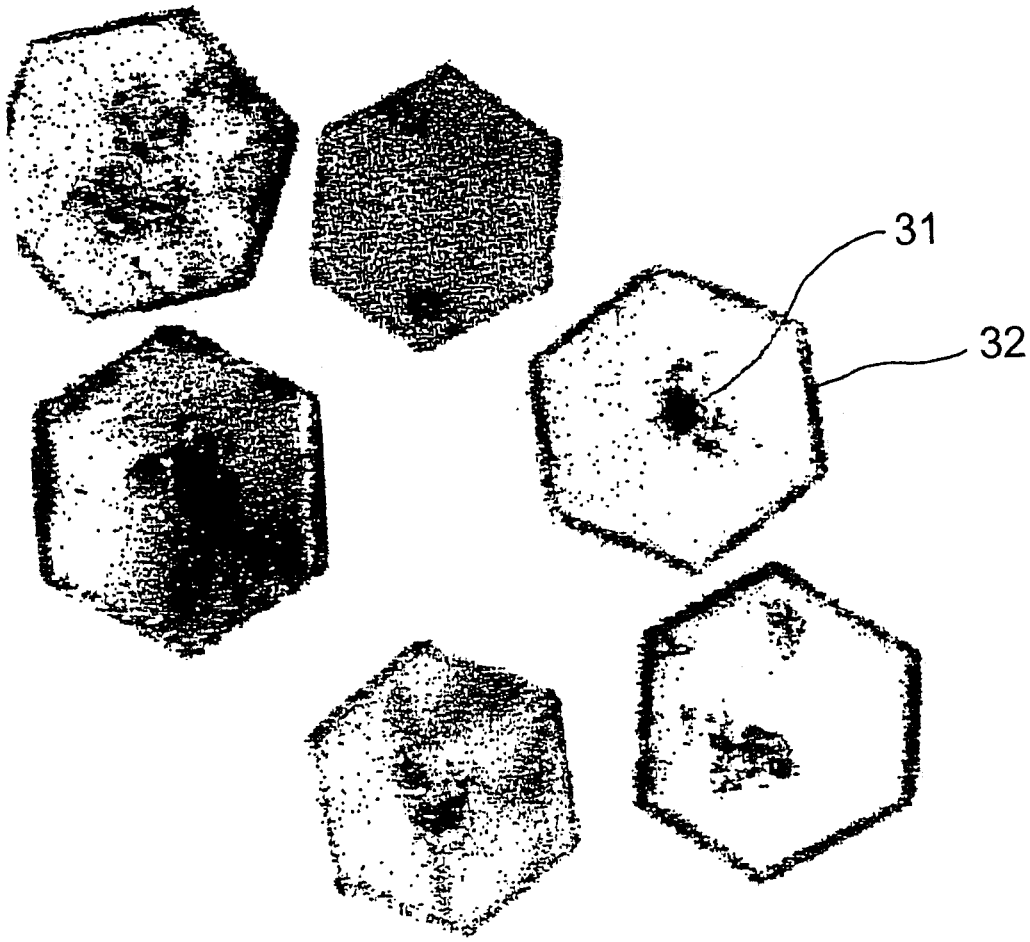
FIG. 2 is an electron micrograph showing silver halide grains of emulsion EM-16.
Figure 3:
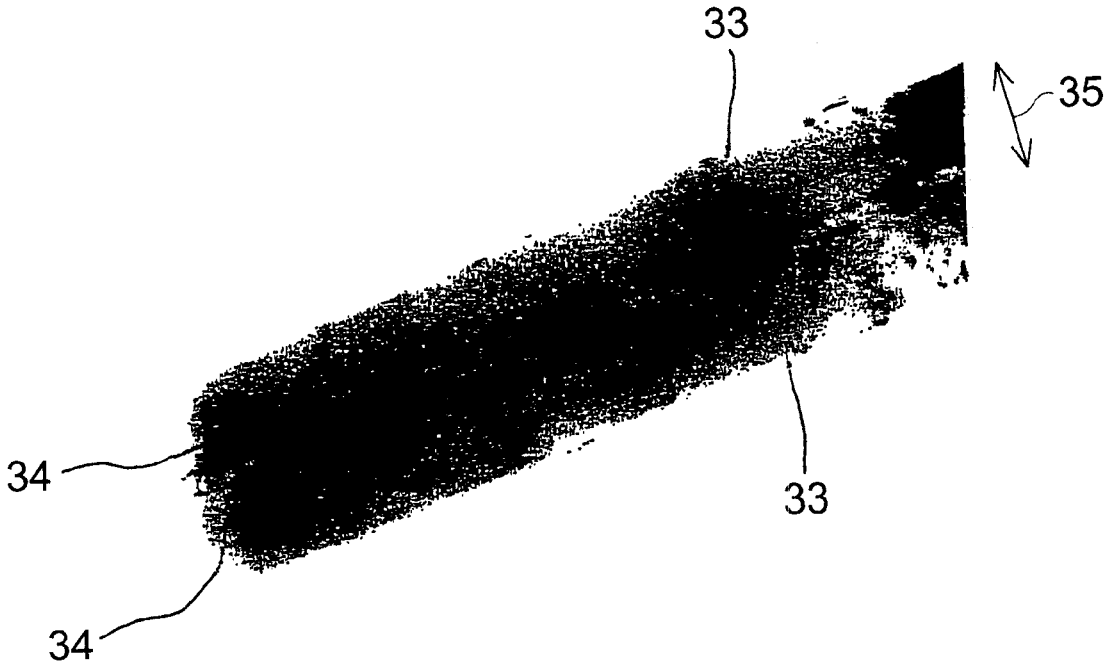
FIG. 3 is an electron micrograph showing section of s silver halide grain of emulsion EM-16.

After completion of the grain growth, the emulsion was adjusted to a pH of 5.80 and EAg of 70 mV at 40° C., similarly to Em-8. The thus obtained emulsion was denoted as EM-16. From electron micrograph of the emulsion grains, it was proved that the emulsion grains were tabular grains having a mean grain diameter of 1.92 μm (i.e., mean value of the circular equivalent diameter of the grain projected area), 50% of the total grain projected area being accounted for by tabular grains exhibiting an aspect ratio of 15.0 or more and a variation coefficient of grain size distribution being 15.0%. In FIG. 2, an electron micrograph of silver halide grains of emulsion EM-16 is shown, in which 31 indicates dislocation lines localized in the central region of the major face and 32 indicating dislocation lines in the peripheral region in the major face. FIG. 3 is an electron micrograph showing the section of the grain of emulsion EM-16, in which 33 and 34 are the major face and twin plane, respectively, and 35 indicating a distance between the major face and the twin plane closest to the major face.

Emulsions EM-1 through EM-16 were summarized with respect to composition and grain structure, as shown in Tables 1 to 3.

TABLE 1

| Emulsion | (1) Av. Grain Diameter (μm) | (2) Aspect Ratio | (3) V.C. of Grain Diameter (%)*1 | (4) V.C. of Grain Thickness (%)*2 | (5) Mean Value of b/a*3 | (6) Grains of 0 ≦ b/a ≦ 1.3*4 |
|---|---|---|---|---|---|---|
| EM-1 (comp.) | 1.51 | 6.7 | 25 | 42 | 1.5 | 30 |
| EM-2 (comp.) | 1.50 | 7.0 | 33 | 50 | 1.6 | 30 |
| EM-3 (comp.) | 1.17 | 4.0 | 25 | 40 | 1.6 | 20 |
| EM-4 (comp.) | 1.50 | 7.2 | 25 | 40 | 1.6 | 30 |
| EM-5 (comp.) | 1.46 | 6.3 | 25 | 40 | 1.6 | 30 |
| EM-6 (comp.) | 1.50 | 7.2 | 25 | 40 | 1.6 | 30 |
| EM-7 (comp.) | 1.85 | 13.5 | 33 | 35 | 1.4 | 50 |
| EM-8 (inv.) | 1.55 | 7.4 | 24 | 25 | 1.3 | 85 |
| EM-9 (inv.) | 1.55 | 7.4 | 24 | 25 | 1.3 | 85 |
| EM-10 (inv.) | 1.57 | 7.6 | 24 | 25 | 1.3 | 85 |
| EM-11 (inv.) | 1.50 | 6.7 | 24 | 25 | 1.3 | 85 |
| EM-12 (inv.) | 1.55 | 6.8 | 24 | 25 | 1.3 | 85 |
| EM-13 (inv.) | 1.55 | 7.0 | 25 | 25 | 1.3 | 85 |
| EM-14 (inv.) | 1.60 | 8.2 | 22 | 23 | 1.2 | 90 |
| EM-15 (inv.) | 1.60 | 8.0 | 17 | 23 | 1.1 | 95 |
| EM-16 (inv.) | 1.92 | 15.0 | 15 | 18 | 1.0 | 100 |

*1: Variation coefficient of grain diameter of total grains
*2: Variation coefficient of grain thickness of total grains
*3: Mean b/a value of tabular grains
*4: Percentage of tabular grains having an aspect ratio of 6.0 or more and meeting 0 ≦ b/a ≦ 1.3, based on total grain projected area

TABLE 2

| | Dislocation Line | | | | | | | |
|---|---|---|---|---|---|---|---|---|
| Emulsion | (7) Peripheral Region *1 | (8) Av. Value (line/grain) *2 | (9) Proportion 1 (%)*3 | (10) proportion 2 (%)*4 | (11) Proportion 3 (%)*5 | (12) V.C of Proportion 3 (%)*6 | (13) Proportion 4 (%)*7 | (14) Proportion 5 (%)*8 |
| EM-1 | Yes | 40 | 70 | 60 | 15 | 35 | 25 | 20 |
| EM-2 | Yes | 30 | 70 | 60 | 12 | 45 | 25 | 20 |
| EM-3 | Yes | 10 | 50 | 40 | 5 | 40 | 25 | 20 |
| EM-4 | Yes | 30 | 70 | 0 | 13 | 35 | 25 | 20 |
| EM-5 | No | 0 | 0 | 0 | — | — | 0 | 0 |
| EM-6 | No | 0 | 0 | 0 | — | — | 0 | 0 |
| EM-7 | Yes | 10 | 60 | 50 | 15 | 45 | 20 | 15 |
| EM-8 | Yes | 60 | 85 | 75 | 25 | 25 | 85 | 85 |
| EM-9 | No | 0 | 0 | 0 | — | — | 0 | 0 |
| EM-10 | Yes | 60 | 85 | 0 | 28 | 25 | 85 | 85 |
| EM-11 | Yes | 30 | 85 | 75 | 42 | 35 | 85 | 85 |
| EM-12 | Yes | 20 | 75 | 65 | 0.4 | 30 | 75 | 75 |
| EM-13 | Yes | 40 | 80 | 70 | 15 | 30 | 75 | 70 |
| EM-14 | Yes | 70 | 90 | 80 | 25 | 20 | 90 | 90 |

TABLE 2-continued

| | Dislocation Line | | | | | | | |
|---|---|---|---|---|---|---|---|---|
| Emulsion | (7) Peripheral Region *1 | (8) Av. Value (line/grain) *2 | (9) Proportion 1 (%)*3 | (10) proportion 2 (%)*4 | (11) Proportion 3 (%)*5 | (12) V.C of Proportion 3 (%)*6 | (13) Proportion 4 (%)*7 | (14) Proportion 5 (%)*8 |
| EM-15 | Yes | 70 | 95 | 85 | 30 | 20 | 95 | 95 |
| EM-16 | Yes | 50 | 100 | 95 | 25 | 10 | 100 | 100 |

*1: Dislocation lines in the peripheral region of the grain
*2: Average value of dislocation lines in the peripheral region of the grain, per grain
*3: Proportion of grains having dislocation lines in the peripheral region (% by number, based on total grains)
*4: Proportion of grains having dislocation lines in the central and peripheral region (% by number, based on total grains)
*5: Average ratio of an area occupied by dislocation lines in the peripheral region to the major face area (%)
*6: Variation coefficient of the ratio of an area occupied by dislocation lines in the peripheral region to the major face area, among grains
*7: Proportion of grains having 10 or more dislocation lines per grains and meeting the requirement, 0 ≦ /a ≦ 1.3 (% by number, based on total grains)
*8: Proportion of grains having 10 or more dislocation lines per grains, meeting the requirement, 0 ≦ b/a ≦ 1.3 (% by number, based on total grains) and exhibiting 0.5 to 40% of the average ratio of an area occupied by dislocation lines in the peripheral region to the major face area (%, based on total grains)

TABLE 3

| Emulsion | (15) Av. Twin Plane Spacing (μm)*1 | (16) V.C. of Twin Plane Spacing (%)*2 | (17) Av. Iodide Content (mol %) | (18) V.C. of Iodine (%)*4 | (19) Av. Max. Edge ratio*5 | (20) V.C. of Max Edge Ratio (%)*6 | (21) Vol. Ratio of Reaction Solution*7 |
|---|---|---|---|---|---|---|---|
| EM-1 | 0.025 | 37 | 2.35 | 35 | 1.6 | 30 | 1 |
| EM-2 | 0.027 | 42 | 2.33 | 43 | 1.8 | 40 | 1 |
| EM-3 | 0.022 | 35 | 2.25 | 40 | 1.7 | 28 | 1 |
| EM-4 | 0.025 | 35 | 2.33 | 32 | 1.6 | 30 | 1 |
| EM-5 | 0.025 | 35 | 1.00 | 30 | 1.6 | 30 | 1 |
| EM-6 | 0.025 | 35 | 1.00 | 28 | 1.6 | 28 | 1 |
| EM-7 | 0.015 | 26 | 2.00 | 40 | 1.7 | 40 | 1 |
| EM-8 | 0.020 | 20 | 2.40 | 25 | 1.3 | 23 | 1/2 |
| EM-9 | 0.020 | 20 | 1.10 | 20 | 1.3 | 23 | 1/2 |
| EM-10 | 0.020 | 20 | 2.38 | 25 | 1.3 | 23 | 1/2 |
| EM-11 | 0.020 | 20 | 2.30 | 27 | 1.3 | 23 | 1/2 |
| EM-12 | 0.020 | 20 | 2.35 | 22 | 1.3 | 23 | 1/2 |
| EM-13 | 0.020 | 25 | 2.33 | 25 | 1.5 | 25 | 2/3 |
| EM-14 | 0.017 | 17 | 2.40 | 20 | 1.2 | 20 | 1/3 |
| EM-15 | 0.015 | 15 | 2.40 | 15 | 1.1 | 15 | 1/5 |
| EM-16 | 0.013 | 10 | 2.40 | 10 | 1.0 | 10 | 1/5 |

*1: Average value of the spacing between twin planes of total tabular grains
*2: Variation coefficient of twin plane spacing among total tabular grains
*3: Average iodide content of total grains
*4: Variation coefficient of the iodide contents among grains
*5: Average value of the ratio of a maximum edge length to a minimum edge length of a hexagonal tabular grain
*6: Variation coefficient of the ratio of a maximum edge length to minimum edge length, among tabular grains
*7: Ratio of the volume of the reaction solution at the completion of ripening to the volume of the reaction solution at the completion of nucleation The obtained emulsions each were subjected to sensitization. Thus, 0.5 mol of each emulsion was melted at 40° C. and after. adjusting the pAg during chemical sensitization to 8.3 to 8.5 with an aqueous potassium bromide solution, spectral sensitizing dyes SD-1, 2 and 3 (1:1:1) were added in an amount giving a total coverage of about 70%. Thereafter, triphosphine selenide, sodium thiosulfate, chloroauric acid, and potassium thicyanate was added thereto to undergo chemical ripening to the optimum level. After completion of chemical ripening were added 4-hydroxy-6-methyl-1,3,3a,7-tetrazaindene (also denoted as TAI) and 1-phenyl-5-mercaptotetrazole (denoted as PMT).

rocal of exposure H (expressed in lux·sec) giving a density of the minimum density (Dmin) plus 0.15, based on the sensitivity of Sample 101 being 100 (in which the more value is the higher sensitivity).

SD-1

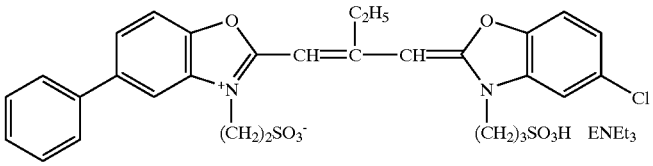

SD-2

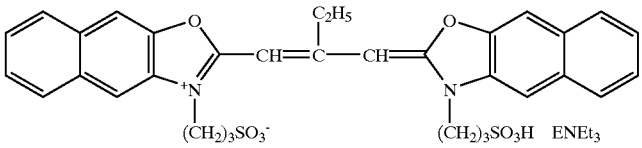

SD-3

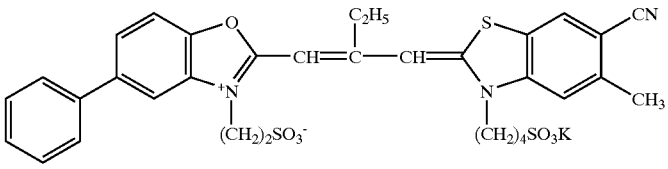

Coupler 1

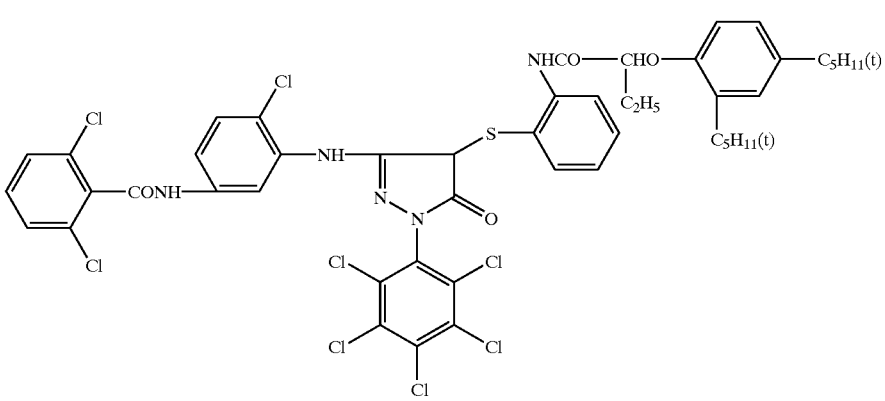

Preparation of Monolayer Photographic Material Sample

Each of the sensitized emulsions was coated on a acetyl cellulose film support covered with antihalation layer of neutral gray silver to form an emulsion layer and the emulsion layer was over-coated with a gelatin layer (4.3 g/m$^2$) containing a surfactant and bis(vinylsulfonyl)methane hardener (in an amount of 1.75% of the total gelatin). In this case, the silver coverage was 0.646 g Ag/m$^2$ and the emulsion layer contained coupler-1, a surfactant and gelatin of 1.08 g/m$^2$ in total. Thus, using emulsions EM-1 through EM-16, photographic material samples 101 through 116 were prepared.

Evaluation of Photographic Performance

Samples 101 through 116 were each exposed through an optical wedge and filter Y-48 (glass filter, available from Toshiba Co., ltd.) and processed according to the steps described below. Then processed samples were measured with respect to the green optical density using a densitometer (PDA-65, available from Konica Corp.) and evaluated with respect to sensitivity, graininess, pressure resistance and radiation ray fogging.

With regard to sensitivity, photographic material samples were processed within 1 min. after exposure (for 1/200 sec.). Sensitivity was represented by a relative value of the recip- Graininess was represented by a relative value of the standard deviation of variation in density (RMS value) when the density of Dmin plus 0.5 was scanned with a microdensitometer with aperture scanning area of 250 $\mu m^2$ (PDA-5, available from Konica Corp.), based on the graininess of Sample 101 being 100. In this case, the less value is superior graininess.

Pressure resistance was measure as follows. Using a scratch tester (available from Shinto Kagaky Co., Ltd.) under the conditions at 23° C. and 55% RH, a needle with top curvature of 0.025 mm was allowed to move on the sample at a constant speed, while being loaded with a load of 5 g. Thereafter, samples were exposed (for 1/200 sec) and processed and with respect to the densities of Dmin and Dmin plus 0.4, density variation of the loaded portion, ΔD1 (Dmin) and ΔD2 (Dmin+0.4) were determined and represented by a relative value, based on ΔD1 and ΔD2 of Sample 101 being 100. In this case, the less value exhibits superior pressure resistance.

To evaluate radiation fogging, photographic material samples were exposed to radiation in exposure dose of 200 mR, using a radiation source having 137 Cs. Exposed samples were also processed similarly to the foregoing to measure the fog density. The radiation fogging was represented by a relative value of a radiation fogging increase (denoted as ΔF), i.e., the difference between the fog density obtained by radiation exposure minus the fog density obtained by conventional exposure, based that of Sample 101 being 100.

Processing Formula and Condition

| Processing step: | | |
|---|---|---|
| 1. Color developing | 3 min. 15 sec. | 38.0 ± 0.1° C. |
| 2. Bleaching | 6 min. 30 sec. | 38.0 ± 3.0° C. |
| 3. Washing | 3 min. 15 sec. | 24 to 41° C. |
| 4. Fixing | 6 min. 30 sec. | 38.0 ± 3.0° C. |
| 5. Washing | 3 min. 15 sec. | 24 to 41° C. |
| 6. Stabilizing | 3 min. 15 sec. | 38.0 ± 3.0° C. |
| 7. Drying | | 50° C. or higher |

Composition of the processing solution used in each step is as follows.

| Color developing solution | |
|---|---|
| 4-Amino-3-methyl-N-ethyl-N-(β-hydroxyethyl)-aniline sulfate | 4.75 g |
| Anhydrous sodium sulfite | 4.25 g |
| Hydroxylamine · 1/2 sulfate | 2.0 g |
| Anhydrous potassium carbonate | 37.5 g |
| Sodium bromide | 1.3 g |
| Trisodium nitrilotriacetate (monohydride) | 2.5 g |
| Potassium hydroxide | 1.0 g |

Water is added to make 1 lit. and the pH is adjusted to 10.1.

| Bleaching solution: | |
|---|---|
| Ammonium iron ethylenediaminetetraacetate | 100 g |
| Ammonium ethylenediaminetetraacetate | 10 g |
| Ammonium bromide | 150 g |
| Glacial acetic acid | 10.0 g |

Water is added to make 1 lit. and the pH is adjusted to 6.0 with ammonia.

| Fixing solution: | |
|---|---|
| Ammonium thiosulfate | 175 g |
| Anhydrous sodium sulfite | 8.5 g |
| Sodium metasulfite | 2.3 g |

Water is added to make 1 lit. and the pH is adjusted to 6.0.

| Stabilizing solution: | |
|---|---|
| Formalin (aqueous 37% solution) | 1.5 ml |
| Koniducks (available from Konica Corp.) | 7.5 ml |
| Water is added to make 1 lit. | |

TABLE 4

| Sample | Sensitivity | Fog | Graininess | ΔD1 | ΔD2 | ΔF |
|---|---|---|---|---|---|---|
| 101 | 100 | 0.20 | 100 | 100 | 100 | 100 |
| 102 | 95 | 0.20 | 110 | 115 | 118 | 120 |
| 103 | 85 | 0.20 | 100 | 110 | 110 | 104 |
| 104 | 100 | 0.20 | 105 | 110 | 108 | 115 |
| 105 | 85 | 0.20 | 100 | 105 | 105 | 110 |
| 106 | 75 | 0.20 | 90 | 93 | 90 | 95 |
| 107 | 100 | 0.20 | 135 | 125 | 140 | 125 |
| 108 | 115 | 0.17 | 93 | 94 | 92 | 96 |
| 109 | 90 | 0.17 | 75 | 85 | 85 | 90 |
| 110 | 115 | 0.17 | 95 | 98 | 98 | 100 |
| 111 | 110 | 0.17 | 95 | 95 | 95 | 98 |
| 112 | 103 | 0.19 | 98 | 98 | 98 | 98 |
| 113 | 108 | 0.18 | 92 | 92 | 92 | 97 |
| 114 | 115 | 0.16 | 90 | 90 | 90 | 94 |
| 115 | 117 | 0.16 | 87 | 87 | 87 | 90 |
| 116 | 120 | 0.16 | 85 | 85 | 85 | 90 |

As can be seen from Table 4, inventive samples exhibited superior sensitivity, graininess and pressure resistance, and improvements in radiation fogging.

Example 2

Preparation of Photographic Material Sample

To emulsion EM-1, sensitizing dyes SD-1, 2 and 3 were added in amounts of $4.0\times10^{-4}$, $8.0\times10^{-5}$ and $5.0\times10^{-5}$ mol/mol Ag, respectively and ripening was carried out at 55° C. for 15 min., then, chemical sensitizers (sodium thiosulfate, chloroauric acid and potassium thiocyanate) were further added thereto to carry out ripening. In this case, the amounts of the chemical sensitizers and the ripening time were adjusted to achieve an optimum sensitivity-fog relationship. After completion of ripening, 10 mg/mol Ag of 1-phenyl-5-mercaptotetrazole. and 500 mg/mol Ag of 4-hydroxy-6-methyl-1,3,3a,7-tetrazaindene were added thereto to stabilize the emulsion.

Preparation of Color Photographic Material

Applying the thus sensitized emulsion to the high-speed green-sensitive layer, the following layers containing composition as shown below were formed on a subbed triacetyl cellulose film support to prepare a multi-layered color photographic material Samples 101 to 105. The addition amount of each compound was represented in term of g/m$^2$, provided that the amount of silver halide or colloidal silver was converted to the silver amount and the amount of a sensitizing dye (denoted as "SD") was represented in mol/Ag mol.

| | |
|---|---|
| 1st Layer: Anti-Halation Layer | |
| Black colloidal silver | 0.16 |
| UV-1 | 0.3 |
| CM-2 | 0.123 |
| CC-1 | 0.044 |
| OIL-1 | 0.167 |
| Gelatin | 1.33 |
| 2nd Layer: Intermediate Layer | |
| AS-1 | 0.160 |
| OIL-1 | 0.20 |
| Gelatin | 0.69 |
| 3rd Layer: Low-speed Red-Sensitive Layer | |
| Silver iodobromide emulsion a | 0.20 |
| Silver iodobromide emulsion b | 0.29 |
| SD-4 | $2.37\times10^{-5}$ |
| SD-5 | $1.2\times10^{-4}$ |

-continued

| | |
|---|---|
| SD-6 | $2.4 \times 10^{-4}$ |
| SD-7 | $2.4 \times 10^{-6}$ |
| C-1 | 0.32 |
| CC-1 | 0.038 |
| OIL-2 | 0.28 |
| AS-2 | 0.002 |
| Gelatin | 0.73 |
| 4th Layer: Medium-speed Red-sensitive Layer | |
| Silver iodobromide emulsion c | 0.10 |
| Silver iodobromide emulsion d | 0.86 |
| SD-4 | $4.5 \times 10^{-5}$ |
| SD-5 | $2.3 \times 10^{-4}$ |
| SD-6 | $4.5 \times 10^{-4}$ |
| C-2 | 0.52 |
| CC-1 | 0.06 |
| D-2 | 0.047 |
| OIL-2 | 0.46 |
| AS-2 | 0.004 |
| Gelatin | 1.30 |
| 5th Layer: High-speed Red-Sensitive Layer | |
| Silver iodobromide emulsion c | 0.13 |
| Silver iodobromide emulsion d | 1.18 |
| SD-4 | $3.0 \times 10^{-5}$ |
| SD-5 | $1.5 \times 10^{-4}$ |
| SD-6 | $3.0 \times 10^{-4}$ |
| C-2 | 0.047 |
| C-3 | 0.09 |
| CC-1 | 0.036 |
| D-2 | 0.024 |
| OIL-2 | 0.27 |
| AS-2 | 0.006 |
| Gelatin | 1.28 |
| 6th Layer: Intermediate Layer | |
| OIL-1 | 0.29 |
| AS-1 | 0.23 |
| Gelatin | 1.00 |
| 7th Layer: Low-speed Green-Sensitive Layer | |
| Silver iodobromide emulsion a | 0.19 |
| Silver iodobromide emulsion b | 0.062 |
| SD-7 | $3.6 \times 10^{-4}$ |
| SD-8) | $3.6 \times 10^{-4}$ |
| Magenta coupler (M-3 | 0.18 |
| CM-2 | 0.033 |
| OIL-1 | 0.22 |
| AS-2 | 0.002 |
| AS-3 | 0.05 |
| Gelatin | 0.61 |
| 8th layer: Interlayer | |
| OIL-1 | 0.26 |
| AS-1 | 0.054 |
| Gelatin | 0.80 |
| 9th Layer: Medium-speed Green-Sensitive Layer | |
| Silver iodobromide emulsion e | 0.54 |
| Silver iodobromide emulsion f | 0.54 |
| SD-1 | $3.7 \times 10^{-4}$ |
| SD-2 | $7.4 \times 10^{-5}$ |
| SD-83 | $5.0 \times 10^{-5}$ |
| M-1 | 0.33 |
| M-3 | 0.17 |
| CM-2 | 0.024 |
| CM-3 | 0.029 |
| D-1 | 0.005 |
| D-3 | 0.024 |
| OIL-1 | 0.73 |
| AS-2 | 0.003 |
| AS-3 | 0.035 |
| Gelatin | 1.80 |
| 10th Layer: High-speed Green-Sensitive Layer | |
| Sensitized emulsion | 1.19 |
| SD-1 | $4.0 \times 10^{-4}$ |
| SD-2 | $8.0 \times 10^{-5}$ |
| SD-3 | $5.0 \times 10^{-5}$ |

-continued

| | |
|---|---|
| M-1 | 0.065 |
| CM-2 | 0.026 |
| CM-3 | 0.022 |
| D-1) | 0.003 |
| D-3 | 0.003 |
| OIL-1 | 0.19 |
| OIL-2 | 0.43 |
| AS-3 | 0.017 |
| AS-2 | 0.014 |
| Gelatin | 1.23 |
| 11th Layer: Yellow Filter Layer | |
| Yellow colloidal silver | 0.05 |
| OIL-1 | 0.18 |
| AS-1 | 0.16 |
| Gelatin | 1.00 |
| 12th Layer: Low-speed Blue-sensitive Layer | |
| Silver iodobromide emulsion b | 0.22 |
| Silver iodobromide emulsion a | 0.08 |
| Silver iodobromide emulsion f | 0.09 |
| SD-9 | $6.5 \times 10^{-4}$ |
| SD-10 | $2.5 \times 10^{-4}$ |
| Y-A | 0.77 |
| D-4 | 0.017 |
| OIL-1 | 0.31 |
| AS-2 | 0.002 |
| Gelatin | 1.29 |
| 13th Layer: High-sped Blue-sensitive Layer | |
| Silver iodobromide emulsion f | 0.41 |
| Silver iodobromide emulsion g | 0.61 |
| SD-9 | $4.4 \times 10^{-4}$ |
| SD-10 | $1.5 \times 10^{-4}$ |
| Y-A | 0.23 |
| OIL-1 | 0.10 |
| AS-2 | 0.004 |
| Gelatin | 1.20 |
| 14th Layer: First Protective Layer | |
| Silver iodobromide emulsion h | 0.30 |
| UV-1 | 0.055 |
| UV-2 | 0.110 |
| OIL-2 | 0.30 |
| Gelatin | 1.32 |
| 15th Layer: Second protective Layer | |
| Polymer PM-1 | 0.15 |
| Polymer PM-2 | 0.04 |
| WAX-1 | 0.02 |
| D-5 | 0.001 |
| Gelatin | 0.55 |

Characteristics of silver iodobromide emulsions described above are shown below, in which the average grain size refers to an edge length of a cube having the same volume as that of the grain.

| Emulsion | Av. grain size (μm) | Av. AgI content (mol %) | Diameter/thickness ratio |
|---|---|---|---|
| a | 0.30 | 2.0 | 1.0 |
| b | 0.40 | 8.0 | 1.4 |
| c | 0.60 | 7.0 | 3.1 |
| d | 0.74 | 7.0 | 5.0 |
| e | 0.60 | 7.0 | 4.1 |
| f | 0.65 | 8.0 | 1.4 |
| g | 1.00 | 8.0 | 2.0 |
| h | 0.05 | 2.0 | 1.0 |

Of the emulsions described above, for example, emulsions d was prepared according to the following procedure described below. Emulsion h was prepared by reference to JP-A 1-183417, 1-183644, 1-183645 and 2-166442.

Preparation of Seed Emulsion-1

To Solution A1 maintained at 35° C. and stirred with a mixing stirrer described in JP-B 58-58288 and 58-58289 were added an aqueous silver nitrate solution (1.161 mol) and an aqueous potassium bromide and potassium iodide mixture solution (containing 2 mol % potassium iodide) by the double jet method in 2 min., while keeping the silver potential at 0 mV (measured with a silver electrode and a saturated silver-silver chloride electrode as a reference electrode), to form nucleus grains. Then the temperature was raised to 60° C. in 60 min. and after the pH was adjusted to 5.0 with an aqueous sodium carbonate solution, an aqueous silver nitrate solution (5.902 mol) and an aqueous potassium bromide and potassium iodide mixture solution (containing 2 mol % potassium iodide) were added by the double jet method in 42 minutes, while keeping the silver potential at 9 mV. After completing the addition, the temperature was lowered to 40° C. and the emulsion was desalted according to the conventional flocculation washing. The obtained seed emulsion was comprised of grains having an average equivalent sphere diameter of 0.24 μm and an average aspect ratio of 4.8. At least 90% of the total grain projected area was accounted for by hexagonal tabular grains having the maximum edge ratio of 1.0 to 2.0. This emulsion was denoted as Seed Emulsion-1

| Solution A1 | |
|---|---|
| Ossein gelatin | 24.2 g |
| Potassium bromide | 10.8 g |
| $HO(CH_2CH_2O)m(CH(CH_3)CH_2O)_{19.8}(CH_2CH_2O)nH$ (M + n= 9.77, 10% ethanol solution) | 6.78 ml |
| 10% Nitrate | 114 ml |
| Distilled water to make | 9657 ml |

Preparation of Fine Silver-Iodide Grain Emulsion SMC-1

To 5 liters of a 6.0 wt. % gelatin solution containing 0.06 mol of potassium iodide, an aqueous solution containing 7.06 mol of silver nitrate and an aqueous solution containing 7.06 mol of potassium iodide, 2 liters of each were added over a period of 10 min., while the pH was maintained at 2.0 using nitric acid and the temperature was maintained at 40° C. After completion of grain formation, the pH was adjusted to 6.0 using a sodium carbonate aqueous solution. The resulting emulsion was comprised of fine silver iodide grains having an average diameter of 0.05 μm, and was denoted as SMC-1.

Preparation of Silver Iodobromide Emulsion d 700 ml of an aqueous 4.5 wt. % inert gelatin solution containing 0.178 mol equivalent of Seed Emulsion-1 and 0.5 ml of a 10% ethanol solution of $HO(CH_2CH_2O)m(CH(CH_3)CH_2O)_{19.8}(CH_2CH_2O)nH$ (m+n=9.77) was maintained at 75° C. and after adjusting the pAg and pH to 8.3 and 5.0, respectively, a silver halide emulsion was prepared while vigorously stirring, according to the following procedure.

1) An aqueous silver nitrate solution of 3.093 mol, SMC-1 of 0.287 mol and an aqueous potassium bromide solution were added by the double jet method while keeping the pAg and pH were maintained at 8.4 and 5.0, respectively.

2) Subsequently, the temperature was lowered to 60° C. and the pAg was adjusted to 9.8. Then, SMC-1 of 0.071 mol was added and ripened for 2 min (introduction of dislocation lines).

3) Further, an aqueous silver nitrate solution of 0.959 mol, SMC-1 of 0.030 mol and an aqueous potassium bromide solution were added by the double jet method while keeping the pAg and pH were maintained at 9.8 and 5.0, respectively.

During the grain formation, each of the solutions was added at an optimal flow rate so as not to cause nucleation or Ostwald ripening. After completing the addition, the emulsion desalted at 40° C. by the conventional flocculation method, gelatin was added thereto and the emulsion was redispersed and adjusted to a pAg of 8.1 and a pH of 5.8. The resulting emulsion was comprised of tabular grains having an average size (an edge length of a cube with an equivalent volume) of 0.75 μm, average aspect ratio of 5.0 and exhibiting the iodide content from the grain interior of 2/8.5/X/3 mol %, in which X represents the dislocation line-introducing position. From electron microscopic observation, it was proved that at least 60% of the total grain projected area was accounted for by grains having 5 or more dislocation lines both in fringe portions and in the interior of the grain. The silver iodide content of the surface was 6.7 mol %.

The thus prepared emulsions d and f were added with sensitizing dyes afore-described and ripened, and then chemically sensitized by adding triphenylphosphine selenide, sodium thiosulfate, chloroauric acid and potassium thiocyanate until relationship between sensitivity and fog reached an optimum point. Silver iodobromide emulsions a, b, c, e, f and g were each spectrally and chemically sensitized in a manner similar to silver iodobromide emulsion d.

In addition to the above composition were added coating aids SU-1, SU-2 and SU-3; a dispersing aid SU-4; viscosity-adjusting agent V-1; stabilizers ST-1 and ST-2; fog restrainer AF-1 and AF-2 comprising two kinds polyvinyl pyrrolidone of weight-averaged molecular weights of 10,000 and 1.100,000; inhibitors AF-3, AF-4 and AF-5; hardener H-1 and H-2; and antiseptic Ase-1.

The structure of the compounds used in the sample are shown below.

C-1

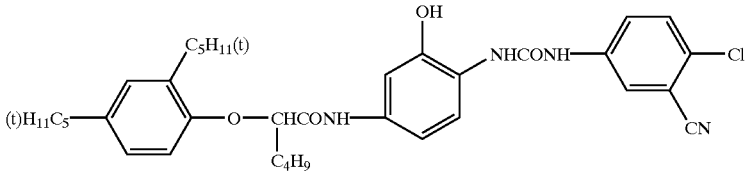

C-2

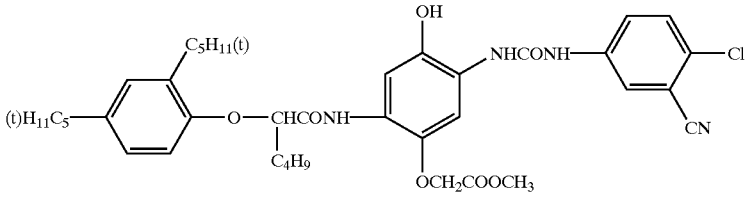

-continued
C-3
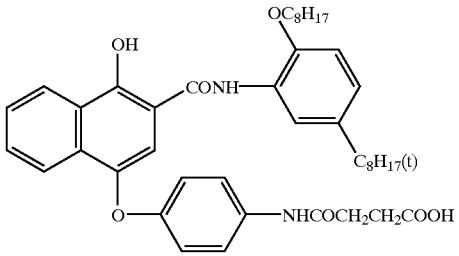
M-3
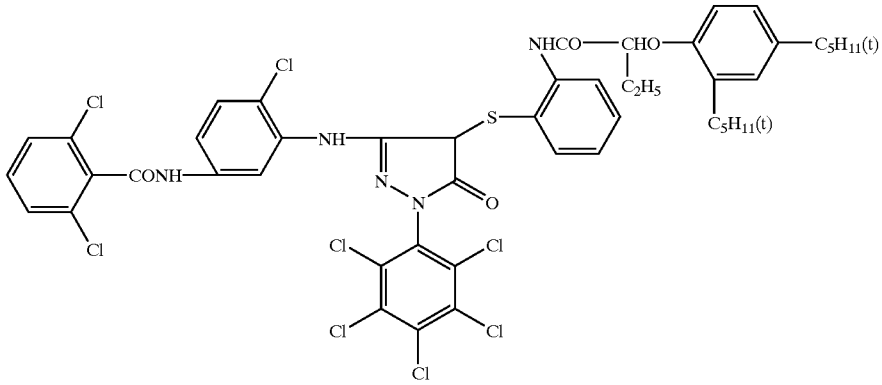
Y-A
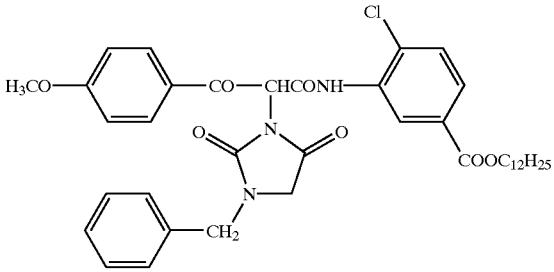
M-1
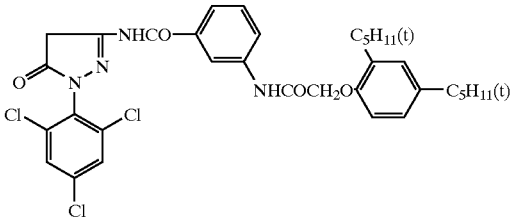
CC-1
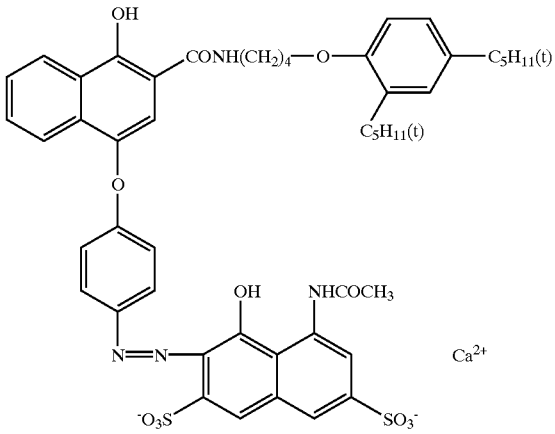

-continued
CM-2
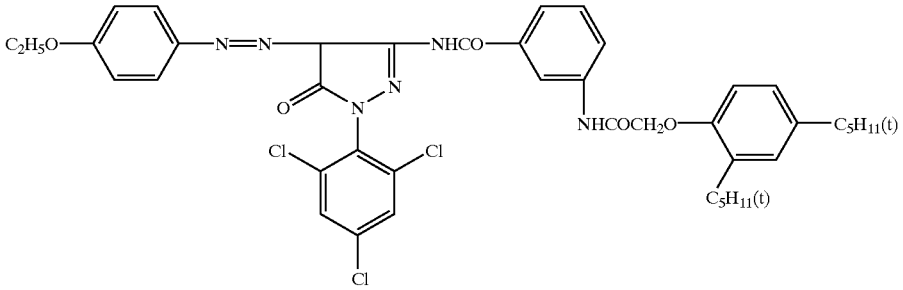
CM-3
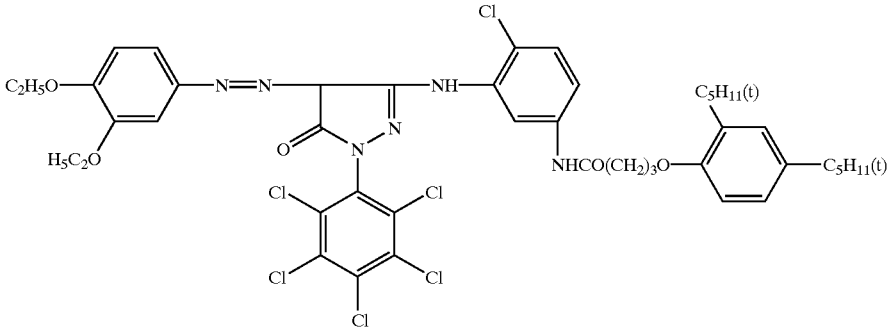
D-2
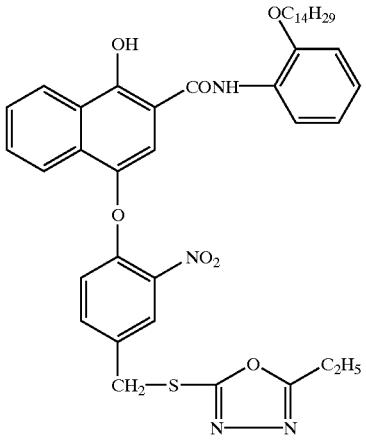
D-3
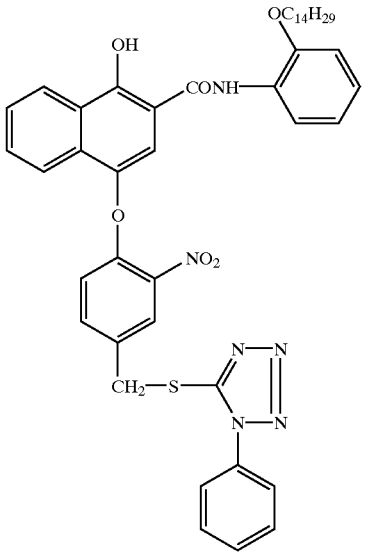
D-4
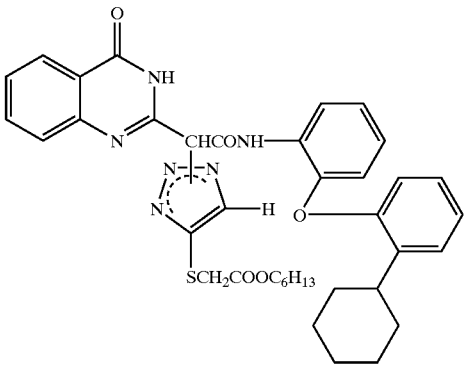

-continued
AS-1
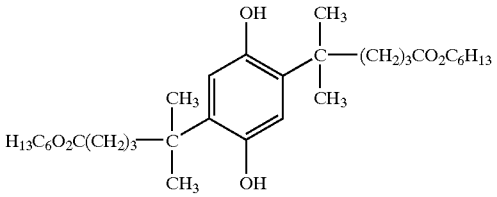
AS-2
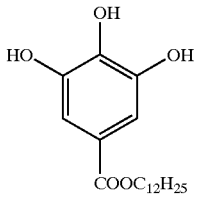
AS-3
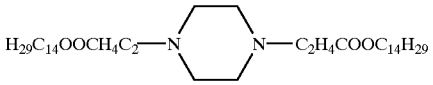
SD-4
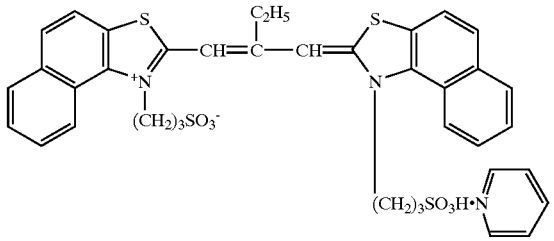
SD-5
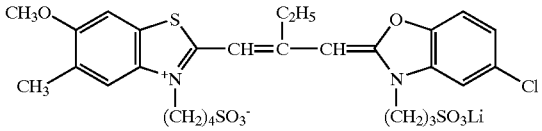
SD-6
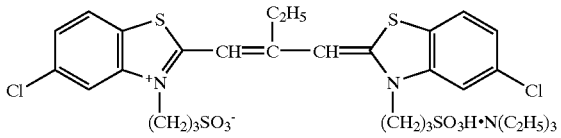
SD-7
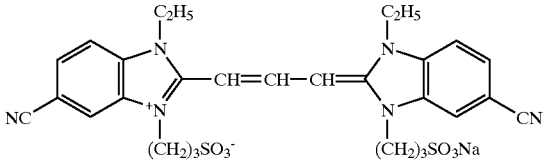
SD-8
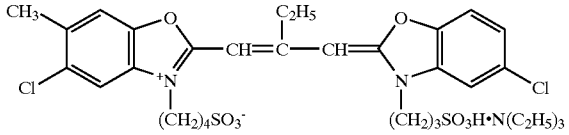
SD-9
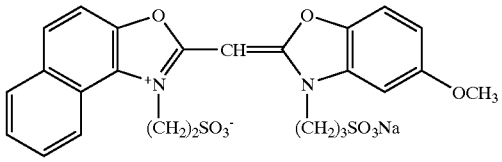
SD-10
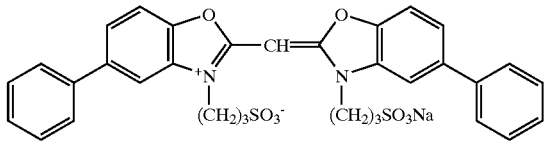
ST-1
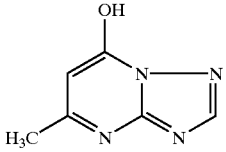
ST-2
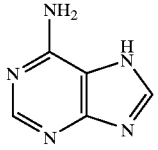
AF-1,2
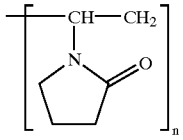
AF-1 Mw ÷ 10,000
AF-2 Mw ÷ 100,000
n: Polymerization degree
AF-3
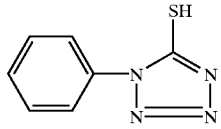
AF-4
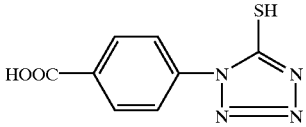
AF-5
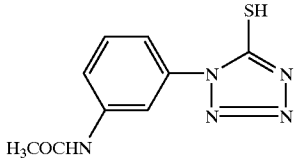
SU-1
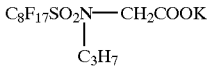
SU-2
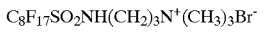

-continued

SU-3

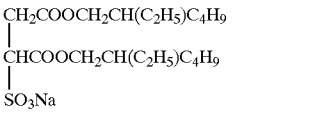

SU-4

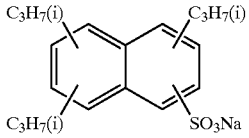

WAX-1

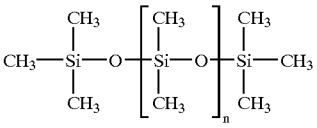

Mw ÷ 3,000

D-5

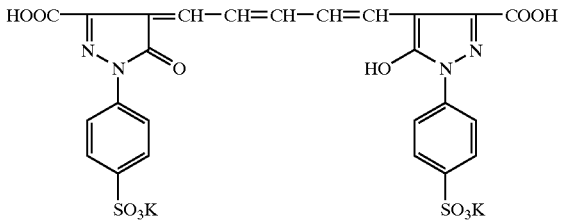

PM-1

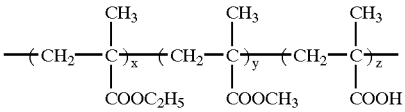

x:y:z = 3:3:4

PM-2

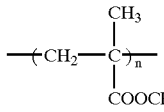

n: Polymerization degree

OIL-1

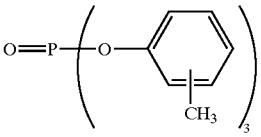

UV-1

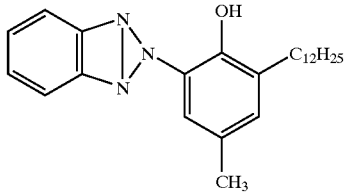

OIL-2

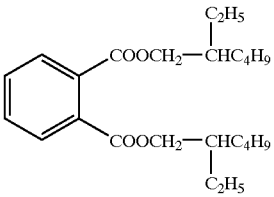

UV-2

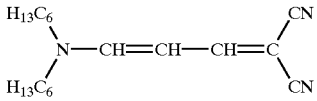

V-1

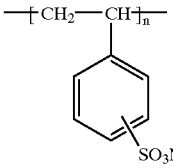

n: Polymerization degree

Ase-1

(Mixture of the following components)

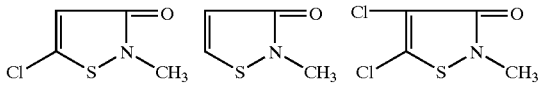

(A) (B) (C)

A:B:C = 50:46:4 (molar ratio)

H-1

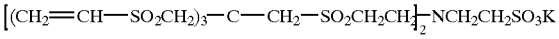

H-2

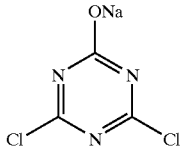

Using emulsions EM-2 through EM-16, photographic samples 202 through 216 were prepared in the same manner as in sample 201, except that emulsion EM-1 was replaced by each of emulsion EM-2 through EM-16.

Processing

The thus prepared photographic material samples were each imagewise exposed to white light, processed similarly to Example 1, except that the color developing time was changed to 3 min. 15 sec. and evaluated similarly. Results thereof are shown in Table 5.

TABLE 5

| | Sensitivity | | Latent Image Stability | | Aging Fog | | |
|---|---|---|---|---|---|---|---|
| Sample | A | Fog | B | C | Variation | ΔD1 | ΔD2 |
| 201 | 100 | 0.20 | −3 | −3 | +0.02 | 100 | 100 |
| 202 | 95 | 0.20 | −4 | −3 | +0.05 | 115 | 118 |
| 203 | 85 | 0.20 | −3 | −3 | +0.02 | 110 | 110 |

TABLE 5-continued

| Sample | Sensitivity A | Fog | Latent Image Stability B | Latent Image Stability C | Aging Fog Variation | ΔD1 | ΔD2 |
|---|---|---|---|---|---|---|---|
| 204 | 100 | 0.20 | −3 | −3 | +0.03 | 110 | 108 |
| 205 | 85 | 0.20 | −3 | −3 | +0.03 | 105 | 105 |
| 206 | 75 | 0.20 | −3 | −3 | +0.02 | 93 | 90 |
| 207 | 110 | 0.20 | −4 | −4 | +0.05 | 125 | 140 |
| 208 | 115 | 0.17 | −1 | −1 | +0.01 | 94 | 92 |
| 209 | 90 | 0.17 | −1 | −1 | +0.01 | 85 | 85 |
| 210 | 115 | 0.17 | −2 | −2 | +0.01 | 98 | 98 |
| 211 | 110 | 0.17 | −2 | −1 | +0.01 | 95 | 95 |
| 212 | 103 | 0.19 | −2 | −2 | +0.01 | 98 | 98 |
| 213 | 108 | 0.18 | −1 | −1 | +0.01 | 92 | 92 |
| 214 | 115 | 0.16 | −1 | −1 | +0.01 | 90 | 90 |
| 215 | 117 | 0.16 | −1 | −1 | +0.01 | 87 | 87 |
| 216 | 120 | 0.16 | −1 | −1 | +0.01 | 85 | 85 |

Photographic sensitivity is represented by a relative value of the reciprocal of exposure giving a density of 0.2 plus a fog density, based on the sensitivity of sample 201 being 100 (in which a larger value exhibits a higher sensitivity).

With regard to latent image stability, each sample was aged under the following conditions, processed and evaluated. Thus, in condition A, the sample, after exposure, was aged in a refrigerator (at −20° C.) until immediately before being processed and was then processed; in condition B, the sample, after exposure, was aged in an atmosphere of 25° C. and 60% RH for 30 days and then processed; and in condition C, the sample, after exposure, was aged in an atmosphere of 55° C. and 80% RH for 30 days and then processed. The reciprocal of exposure giving a density of 0.2 plus a fog density was relatively determined for each sample, based on the value of condition A being 100. Further, variation of the relative value at condition B, i.e., the difference in relative value between conditions B and A and variation of the relative value at condition C, i.e., the difference in relative value between conditions C and A were determined and represented as a latent image variation at ordinary temperature and ordinary humidity (condition B) and latent image variation at high temperature and high humidity (condition C), respectively.

An increase in fog density of the sample processed after being aged at 55° C. and 60% RH for 20 days before exposure, relative to the sample processed after being aged in a refrigerator (at −20° C.) was determined for each sample and represented as aging fog variation, indicating a measure for aging stability.

Graininess was represented by a relative value of the standard deviation of variation in density (RMS value) when the density of Dmin plus 0.5 was scanned with a microdensitometer with an aperture scanning area of 250 $\mu m^2$ (PDA-5, available from Konica Corp.), based on the graininess of Sample 201 being 100. In this case, the lower value is superior graininess.

Pressure resistance was measure as follows. Using a scratch tester (available from Shinto Kagaky Co., Ltd.) under conditions of 23° C. and 55% RH, a needle with top curvature of 0.025 mm was allowed to move on the sample at a constant speed, while being loaded with a load of 5 g. Thereafter, samples were exposed and processed and with respect to the densities of Dmin and Dmin plus 0.4, density variation of the loaded portion, ΔD1 (Dmin) and ΔD2 (Dmin+0.4) were determined and represented by a relative value, based on ΔD1 and ΔD2 of Sample 201 being 100. In this case, the lower value exhibits superior pressure resistance.

As apparent from the results shown in Table 5, photographic material samples Nos. 208 through 216 which contained the inventive emulsions exhibited enhanced sensitivity and improved storage stability and pressure resistance. Of these, sample No. 216 containing emulsion EM-16 exhibited specifically superior results.

Mechanism of displaying effects of this invention has not been definitely clarified but it is contemplated that a short twin plane spacing and precise control of the ratio of the spacing between one major face and the twin plane closest thereto to the spacing between the other major face and the twin plane closest thereto and the mean grain thickness led to uniformity of entire grains. As described above, silver halide emulsions exhibiting enhanced sensitivity, superior graininess and improved pressure resistance and silver halide photographic materials using the same can be obtained according to this invention. Tabular silver halide grains used in this invention are shown in FIGS. 2 and 3.

Example 3

Exemplary application of the silver halide emulsion used in this invention to a monopack diffusion transfer photographic light sensitive material used for negative-positive reflection prints is shown below. Thus, a diffusion transfer photographic material sample No. 301 was prepared in accordance with Example of JP-B 52-18024, provided that the following emulsions EM-17, 18 and 19 were used as the red-sensitive silver iodobromide emulsion of the 2nd layer, the green-sensitive silver iodobromide emulsion of the 5th layer and the blue-sensitive silver iodobromide emulsion of the 8th layer, respectively:

EM-17: polydisperse silver iodobromide emulsion (3 mol % iodide), a mean grain diameter of 1.7 $\mu$m.

EM-18: polydisperse silver iodobromide emulsion (3 mol % iodide), a mean grain diameter of 1.8 $\mu$m, and EM-19: polydisperse silver iodobromide emulsion (3 mol % iodide), a mean grain diameter of 2.0 $\mu$m.

Sample Nos. 302 and 303 were prepared in the same manner as in sample No. 301, except that emulsion were replaced as below:

| Sample No. | Red-sensitive Layer Emulsion No. | Green-sensitive Layer Emulsion No. | Blue-sensitive Layer Emulsion No. |
|---|---|---|---|
| 301 | EM-17 (150) | EM-18 (100) | EM-19 (129) |
| 302 | EM-7 (65)<br>Silver iodo-bromide h (65) | EM-6 (45)<br>Silver iodo-bromide c (45) | EM-7 (59)<br>EM-6 (59) |
| 303 | EM-16 (65)<br>Silver iodo-bromide h (65) | EM-11 (45)<br>Silver iodo-bromide c (45) | EM-16 (59)<br>EM-11 (59) |

Values in parentheses indicated the silver coating amount in $\mu g/cm^2$. Samples each were evaluated with respect to progression of image density and temperature dependence at the time of exposure and development.

Progression of Image Density

After photographing black-and-white and color patch images for sensitometry use in an atmosphere of 20° C. and developing a developer composition by paired pressure rollers, progression of the cyan image density which was measured by red light was evaluated at the time steps.

Temperature Dependence of Exposure and Development

The above-described progression of image density was tested with respect to the atmospheres of 10° C. and 30° C. Results thereof are shown below.

| Temperature | Sample | 30 sec | 45 sec | 60 sec |
|---|---|---|---|---|
| 10° C. | 301 | 1.26 | 1.49 | 1.68 |
| | 302 | 1.30 | 1.57 | 1.81 |
| | 303 | 1.57 | 1.74 | 1.97 |
| 20° C. | 301 | 1.37 | 1.65 | 1.84 |
| | 302 | 1.41 | 1.72 | 1.92 |
| | 303 | 1.63 | 1.93 | 2.03 |
| 30° C. | 301 | 1.46 | 1.71 | 2.00 |
| | 302 | 1.59 | 1.83 | 2.04 |
| | 303 | 1.78 | 2.04 | 2.06 |

As can be seen from the above results, it was proved that diffusion transfer photographic material samples using silver halide tabular grain emulsion used in this invention exhibited enhanced image forming speed and little developing temperature dependence in spite of the reduced silver coverage, sample No. 303 was superior in image graininess which was visually evaluated.

Example 4

Exemplary application of the silver halide emulsion used in this invention to a peel-apart type diffusion transfer photographic light sensitive material used reflection prints is shown below. Thus, a peel-apart type diffusion transfer photographic material sample No. 401 was prepared in accordance with Example of JP-A 11-509649, provided that polydisperse regular crystal grain emulsions having the following mean grain diameter were prepared and employed as silver iodobromide (0.7, 1.5 and 1.8 μm) of the red-sensitive silver iodobromide layer, silver iodobromide (0.6, 1.1 and 1.3 μm) of the green-sensitive silver iodobromide layer, and silver iodobromide (1.2 and 2.0 μm) of the blue-sensitive silver iodobromide layer.

Samples Nos. 402 and 403 were prepared in the same manner as Sample No. 401, except that the emulsions were replaced by the emulsions used in Example 2, as below:

| Sample No. | Red-sensitive Layer Emulsion No. | Green-sensitive Layer Emulsion No. | Blue-sensitive Layer Emulsion No. |
|---|---|---|---|
| 402 | EM-7 (0.5)<br>Silver iodo-bromide h (0.5) | EM-6 (0.3)<br>Silver iodo-bromide c (0.3) | EM-7 (0.5)<br>EM-6 (0.5) |
| 403 | EM-16 (0.5)<br>Silver iodo-bromide h (0.5) | EM-11 (0.3)<br>Silver iodo-bromide c (0.3) | EM-16 (0.5)<br>EM-11 (0.5) |

Values in parentheses indicated the silver coating amount in g/m$^2$. Similarly to Example 3, samples were evaluated with respect to progrssionof image density and exposure-development temperature dependence. As a result, it was proved that diffusion transfer photographic materials using silver halide tabular grain emulsions used in this invention exhibited superior performance. Specifically, sample No. 403 was superior in image graininess.

| Temperature | Sample | 45 sec | 60 sec | 90 sec | 120 sec |
|---|---|---|---|---|---|
| 10° C. | 401 | 1.03 | 1.24 | 1.49 | 1.66 |
| | 402 | 1.17 | 1.31 | 1.58 | 1.82 |
| | 403 | 1.22 | 1.58 | 1.75 | 1.98 |

-continued

| Temperature | Sample | 45 sec | 60 sec | 90 sec | 120 sec |
|---|---|---|---|---|---|
| 20° C. | 401 | 1.19 | 1.38 | 1.67 | 1.85 |
| | 402 | 1.20 | 1.43 | 1.71 | 1.91 |
| | 403 | 1.25 | 1.64 | 1.89 | 2.03 |
| 30° C. | 401 | 1.25 | 1.45 | 1.72 | 2.01 |
| | 402 | 1.27 | 1.57 | 1.80 | 2.05 |
| | 403 | 1.31 | 1.76 | 2.07 | 2.09 |

What is claimed is:

1. A silver halide emulsion comprising silver halide grains, wherein a variation coefficient of grain diameter of the whole silver halide grains is not more than 25%, wherein at least 50% of the total grain projected area is accounted for by tabular grains having two twin planes and an aspect ratio of not less than 6 and meeting the following requirement (1):

$$1.0 \leqq b/a \leqq 1.3 \quad (1)$$

wherein, of a distance between one major face and the twin plane closest thereto, and a distance between the other major face and the twin plane closest thereto, "a" is a shorter distance and "b" is a longer distance.

2. The silver halide emulsion of claim 1, wherein at least 50% by number of the tabular grains is accounted for by tabular grains having dislocation lines of 10 or more per grain which are localized in the peripheral region of the grain and an area ratio of the region occupied by the dislocation lines being 5 to 40% of the major face and a variation coefficient of the area ratio being not more than 30%.

3. The silver halide emulsion of claim 1, wherein a variation coefficient of grain thickness of the silver halide grains contained in the emulsion is not more than 30%.

4. The silver halide emulsion of claim 2, wherein a variation coefficient of grain thickness of the silver halide grains contained in the emulsion is not more than 30%.

5. The silver halide emulsion of claim 1, wherein the tabular grains have a mean spacing between twin planes of 0.013 to 0.017 μm.

6. The silver halide emulsion of claim 5, wherein the tabular grains have a mean grain thickness of 0.05 to 1.5 μm.

7. The silver halide emulsion of claim 1, wherein a variation coefficient of spacing between twin planes of the tabular grains is not more than 25%.

8. The silver halide emulsion of claim 5, wherein a variation coefficient of spacing between twin planes of the tabular grains is not more than 25%.

9. The silver halide emulsion of claim 1, wherein at least 50% by number of the tabular grains is accounted for by hexagonal tabular grains exhibiting a mean value of a ratio of maximum edge length to a minimum edge length of not more than 1.5, and a variation coefficient of the ratio of maximum edge length to a minimum edge length being not more than 25%.

10. The silver halide emulsion of claim 1, wherein a variation coefficient of iodide content distribution among the silver halide grains contained in the emulsion is not more than 25%.

11. The silver halide emulsion of claim 1, wherein at least 40% by number of the tabular grains is accounted for by tabular grains having dislocation lines in the central and peripheral regions of the major face.

12. The silver halide emulsion of claim 1, wherein the silver halide emulsion is prepared by a process comprising nucleation and grain growth, wherein a part of water of the emulsion is removed through ultrafiltration over a period of after completion the nucleation and before completion of the grain growth to maintain the intergrain distance between silver halide grain or to decrease the intergrain distance.

13. A silver halide color photographic material comprising a support having thereon a red-sensitive layer, a green-sensitive layer, a blue-sensitive layer and a light-insensitive layer, wherein at least one of the red-, green- and blue-sensitive layers comprises the silver halide emulsion as claimed in claim 1.

* * * * *